US011247857B2

(12) United States Patent
Yamaguchi

(10) Patent No.: US 11,247,857 B2
(45) Date of Patent: Feb. 15, 2022

(54) SHEET FEEDING APPARATUS, IMAGE READING APPARATUS AND IMAGE FORMING APPARATUS

(71) Applicant: CANON KABUSHIKI KAISHA, Tokyo (JP)

(72) Inventor: Takuya Yamaguchi, Nagareyama (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 238 days.

(21) Appl. No.: 16/701,509

(22) Filed: Dec. 3, 2019

(65) Prior Publication Data

US 2020/0189865 A1 Jun. 18, 2020

(30) Foreign Application Priority Data

Dec. 13, 2018 (JP) ..... JP2018-233664

(51) Int. Cl.
*B65H 1/12* (2006.01)
*B65H 3/06* (2006.01)
*B65H 11/00* (2006.01)

(52) U.S. Cl.
CPC ..... *B65H 1/12* (2013.01); *B65H 3/0676* (2013.01); *B65H 11/00* (2013.01); *B65H 2402/31* (2013.01); *B65H 2404/1521* (2013.01)

(58) Field of Classification Search
CPC ..... B65H 3/0676; B65H 1/12; B65H 11/00; B65H 2402/31; B65H 2404/1521; B65H 1/266; B65H 1/14; B65H 1/18
USPC ..... 271/117, 118
See application file for complete search history.

(56) References Cited

U.S. PATENT DOCUMENTS 5,893,555 A * 4/1999 Kawada ..... B65H 1/24 271/117
7,513,496 B2 * 4/2009 Hattori ..... B65H 1/12 271/117
7,681,877 B2 * 3/2010 Won ..... G03G 15/6511 271/127
7,963,519 B2 * 6/2011 Bokelman ..... B65H 3/0684 271/117
8,118,298 B2 2/2012 Ueyama et al.
8,655,255 B2 * 2/2014 Ichikawa ..... B65H 1/04 399/388
9,670,014 B2 * 6/2017 Okamoto ..... B65H 1/12
(Continued)

FOREIGN PATENT DOCUMENTS

JP 2008-019069 A 1/2008
JP 2010-275079 A 12/2010

*Primary Examiner* — Michael McCullough
(74) *Attorney, Agent, or Firm* — Venable LLP

(57) ABSTRACT

A holding member is configured to hold a feed member and movable up and down. A lever member is configured to pivot on a pivot shaft and includes a contact portion configured to be in contact with the holding member. An elastic member is connected to the lever member and configured to urge the holding member downward through the lever member. The elastic member is disposed such that, when viewed in an axial direction of the pivot shaft of the lever member, a distance from the pivot shaft to a line of action of a force applied by the elastic member to the lever member in a case where the feed member is located at a first position is shorter than a distance from the pivot shaft to the line of action in a case where the feed member is located at a second position below the first position.

18 Claims, 14 Drawing Sheets

(56) References Cited

U.S. PATENT DOCUMENTS

2010/0301543 A1* 12/2010 Ueyama ..... B65H 3/5223
271/117
2019/0193970 A1 6/2019 Yamaguchi

* cited by examiner

EXAMPLE 1

EXAMPLE 2

EXAMPLE 3

EXAMPLE 4

EXAMPLE 5

SHEET FEEDING APPARATUS, IMAGE READING APPARATUS AND IMAGE FORMING APPARATUS

BACKGROUND OF THE INVENTION

Field of the Invention

The present invention relates to a sheet feeding apparatus configured to feed a sheet, an image reading apparatus configured to read image information from the sheet, and an image forming apparatus configured to form an image on the sheet.

Description of the Related Art

A sheet feeding apparatus configured to feed a sheet used as a recording medium or a document in an image forming apparatus, such as a printer, a copier and a multi-function printer, includes a feed member configured to deliver a sheet out of a tray and a separation member configured to separate the sheet such that sheets are conveyed one by one. A pressurizing force applied to the sheet by the feed member is preferable to stay within a certain range close to a designed value in order to feed the sheet stably in general. If the pressurizing force applied to the sheet by the feed member is too high, for example, a next sheet underlying an uppermost sheet in contact with the feed member is also moved to the separation member. Then, as the next sheet abuts with the separation member and deflects, the next sheet is likely to be buckled. If the pressurizing force of the feed member is too low on the other hand, a conveyance resistance that the sheet receives may surpasses a conveying force applied to the sheet by the feed member and a conveyance failure is likely to occur.

Japanese Patent Application Laid-open No. 2008-19069 discloses a technology of controlling a pressurizing force of a pickup roller by changing a length of a compression spring urging the pickup roller downward by a cam mechanism based on a detection signal of a sensor detecting a sheet conveyance failure and an occurrence of double feed.

However, the configuration described in Japanese Patent Application Laid-open No. 2008-19069 complicates the apparatus by providing the cam mechanism and a control circuit for controlling operations of the cam mechanism, thus leading to an increase of costs.

SUMMARY OF THE INVENTION

The present invention provides a sheet feeding apparatus, an image reading apparatus, and an image forming apparatus that achieve stable sheet feeding with a simple configuration.

According to one aspect of the invention, a sheet feeding apparatus includes: a sheet stacking portion on which a sheet is stacked; a feed member disposed above the sheet stacking portion and configured to feed the sheet stacked on the sheet stacking portion; a lift portion configured to lift the sheet stacking portion; a driving source configured to drive the lift portion; a detection unit configured to detect height of an upper surface of the sheet stacked on the sheet stacking portion; a control portion configured to control the driving source so as to lift the sheet stacking portion by the lift portion based on a detection result of the detection unit; a holding member configured to hold the feed member and movable up and down; a lever member configured to pivot on a pivot shaft and including a contact portion configured to be in contact with the holding member; and an elastic member connected to the lever member and configured to urge the holding member downward through the lever member, wherein the elastic member is disposed such that, when viewed in an axial direction of the pivot shaft of the lever member, a distance from the pivot shaft to a line of action of a force applied by the elastic member to the lever member in a case where the feed member is located at a first position is shorter than a distance from the pivot shaft to the line of action in a case where the feed member is located at a second position below the first position.

According to another aspect of the invention, an image reading apparatus includes: a sheet feeding apparatus configured to feed a sheet; and an image reading portion configured to read image information from the sheet fed from the sheet feeding apparatus, wherein the sheet feeding apparatus includes: a sheet stacking portion on which a sheet is stacked; a feed member disposed above the sheet stacking portion and configured to feed the sheet stacked on the sheet stacking portion; a lift portion configured to lift the sheet stacking portion; a driving source configured to drive the lift portion; a detection unit configured to detect height of an upper surface of the sheet stacked on the sheet stacking portion; a control portion configured to control the driving source so as to lift the sheet stacking portion by the lift portion based on a detection result of the detection unit; a holding member configured to hold the feed member and movable up and down; a lever member configured to pivot on a pivot shaft and including a contact portion configured to be in contact with the holding member; and an elastic member connected to the lever member and configured to urge the holding member downward through the lever member, wherein the elastic member is disposed such that, when viewed in an axial direction of the pivot shaft of the lever member, a distance from the pivot shaft to a line of action of a force applied by the elastic member to the lever member in a case where the feed member is located at a first position is shorter than a distance from the pivot shaft to the line of action in a case where the feed member is located at a second position below the first position.

According to still another aspect of the invention, an image forming apparatus includes: a sheet feeding apparatus configured to feed a sheet; an image forming unit configured to form an image on the sheet fed from the sheet feeding apparatus, wherein the sheet feeding apparatus includes: a sheet stacking portion on which a sheet is stacked; a feed member disposed above the sheet stacking portion and configured to feed the sheet stacked on the sheet stacking portion; a lift portion configured to lift the sheet stacking portion; a driving source configured to drive the lift portion; a detection unit configured to detect height of an upper surface of the sheet stacked on the sheet stacking portion; a control portion configured to control the driving source so as to lift the sheet stacking portion by the lift portion based on a detection result of the detection unit; a holding member configured to hold the feed member and movable up and down; a lever member configured to pivot on a pivot shaft and including a contact portion configured to be in contact with the holding member; and an elastic member connected to the lever member and configured to urge the holding member downward through the lever member, wherein the elastic member is disposed such that, when viewed in an axial direction of the pivot shaft of the lever member, a distance from the pivot shaft to a line of action of a force applied by the elastic member to the lever member in a case where the feed member is located at a first position is shorter than a distance from the pivot shaft to the line of action in a case where the feed member is located at a second position below the first position.

According to still another aspect of the invention, a sheet feeding apparatus includes: a sheet stacking portion on which a sheet is stacked; a feed member disposed above the sheet stacking portion and configured to feed the sheet stacked on the sheet stacking portion; a holding member configured to hold the feed member and being movable up and down in a vertical direction; a lever member configured to pivot on a pivot shaft and including a contact portion configured to be in contact with the holding member; and an elastic member connected to the lever member and configured to urge the holding member downward through the lever member, wherein the elastic member is disposed such that, when viewed in an axial direction of the pivot shaft of the lever member, a distance from the pivot shaft to a line of action of a force applied by the elastic member to the lever member when the feed member is located at a first position is shorter than a distance from the pivot shaft to the line of action when the feed member is located at a second position below the first position, wherein when viewed in the vertical direction, the lever member extends in a width direction perpendicular to a sheet feeding direction of the feed member from the contact portion contacting the holding member to the pivot shaft, and wherein a position in the sheet feeding direction where the contact portion of the lever member comes into contact with the holding member overlaps with a position of the feed member in the sheet feeding direction.

Further features of the present invention will become apparent from the following description of exemplary embodiments with reference to the attached drawings.

DESCRIPTION OF THE EMBODIMENTS

An exemplary embodiment of the present disclosure will be described below with reference to the drawings.

Figure 1:
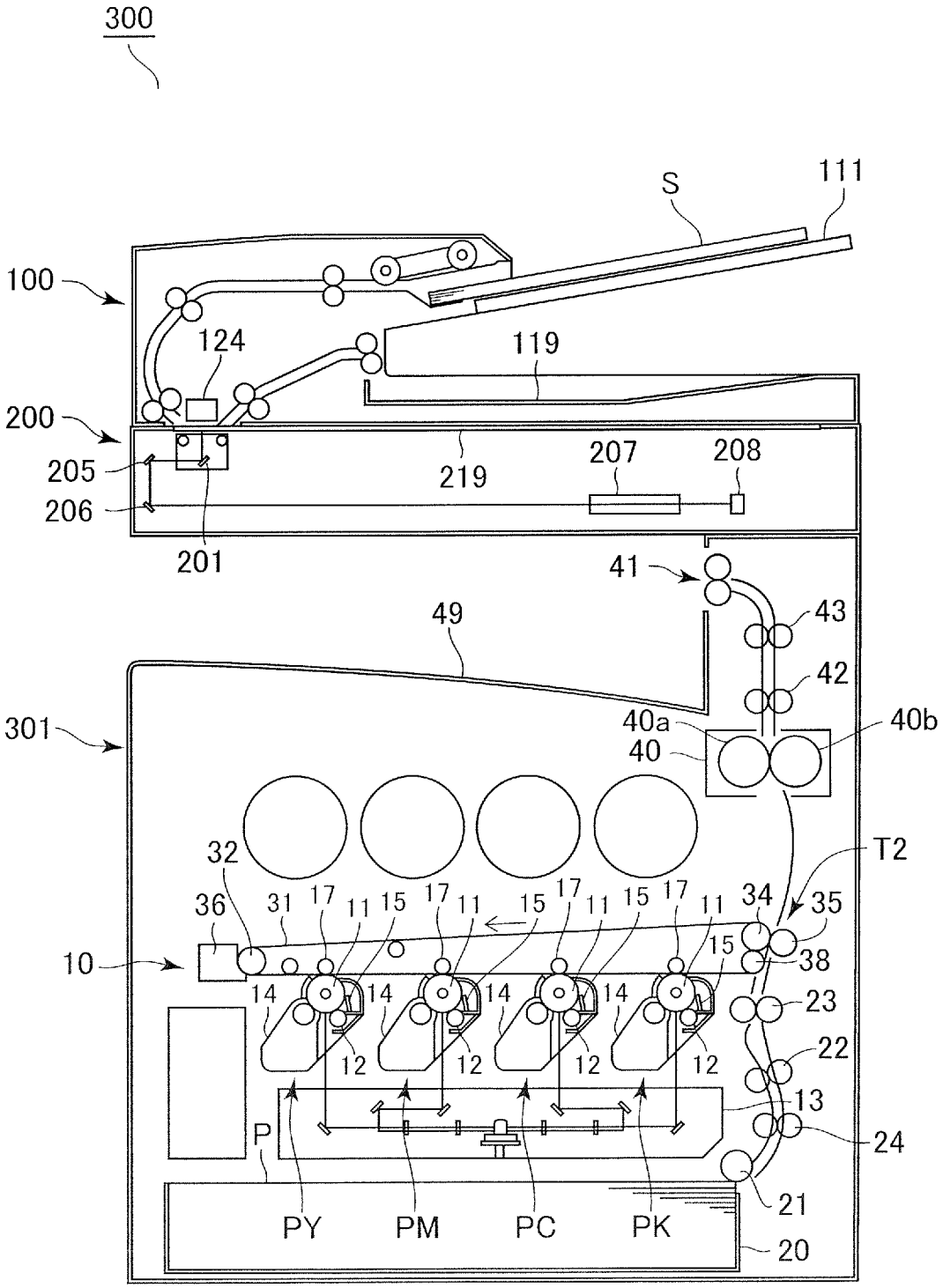
FIG. 1 is a schematic diagram illustrating a configuration of an image forming apparatus according to an embodiment of the present disclosure.

FIG. 1 is a schematic diagram illustrating a configuration of an image forming apparatus 300 of the present embodiment. The image forming apparatus 300 includes an image forming unit 301, an image reading unit 200 disposed above the image forming unit 301, and an auto document feeder (ADF) 100 placed above the image reading unit 200. The image forming unit 301 forms an image on a sheet P serving as a recording medium based on image information inputted from an external personal computer or image information read from a document by the image reading unit 200. The sheet serving as the recording medium or the document includes a sheet of paper such as a sheet of plain paper and an envelope, a plastic film for use in an overhead projector and a cloth.

The image forming unit 301 has an intermediate transfer type electro-photographic unit 10 including four image forming stations PY, PM, PC and PK, an intermediate transfer belt 31 and a fixing unit 40. Each of the image forming stations PY through PK forms a toner image on a surface of a photosensitive drum 11 through an electrophotographic process. That is, when each of the image forming stations PY through PK are required to form the toner image, the photosensitive drum 11 serving as a photosensitive member is rotationally driven and a charging unit homogeneously charges the surface of the photosensitive drum 11. An exposing unit 13 irradiates the surface of the photosensitive drum 11 with a laser beam based on image information to draw an electrostatic latent image on the photosensitive drum 11. A developing unit 14 supplies electrified toner particles to the photosensitive drum 11 to develop the electrostatic latent image as a toner image. The toner images of respective colors formed by the image forming stations PY through PK are primarily transferred from the photosensitive drum 11 to the intermediate transfer belt 31 by primary transfer rollers 17. Adhesives such as the toner left on the photosensitive drum 11 are removed by a drum cleaner 15.

The intermediate transfer belt 31 serving as an intermediate transfer member is wrapped around a secondary transfer inner roller 34, a tension roller 38 and a stretch roller 32 and is rotationally driven counterclockwise in FIG. 1. A toner image borne on the intermediate transfer belt 31 is secondarily transferred onto the sheet P at a secondary transfer portion T2 serving as a nip portion between a secondary transfer roller 35, facing the secondary transfer inner roller 34, and the intermediate transfer belt 31. Adhesives such as the toner left on the intermediate transfer belt 31 are removed by a belt cleaner 36.

The sheet P onto which the toner image have been transferred is then delivered to the fixing unit 40. The fixing unit 40 includes a fixing roller 40*a* and a pressure roller 40*b* nipping and conveying the sheet P and a heat source such as a halogen heater heating the fixing roller 40*a*. The fixing unit 40 melts the toner by applying heat and pressure to the toner image while conveying the sheet P, and as the toner is solidified then, the image is fixed to the sheet P.

In parallel with such image forming process, the sheet P is fed one by one out of the cassette 20. The sheet P delivered out of the cassette 20 by a feed roller 21 serving as a feed member is fed while being separated from another sheet by a separation member such as a separation roller or a separation pad, and is conveyed through a pulling roller 24. After that, a pre-registration roller 22 causes a leading edge of the sheet P to butt against a registration roller 23 in a stop condition to correct a skew of the sheet P. The registration roller 23 sends the sheet P to the secondary transfer portion T2 in synchronism with a progress of the abovementioned image forming process of the electro-photographic unit 10. The sheet P onto which the image has been formed by passing through the secondary transfer portion T2 and the fixing unit 40 is conveyed to a sheet discharge roller 41 through conveyance roller pairs 42 and 43 and is discharged out to a sheet discharge tray 49 provided above the image forming unit 301.

In the above description, the electro-photographic unit 10 is just one example of the image forming unit, and a direct transfer type electro-photographic unit configured to transfer a toner image directly from a photosensitive member to a sheet P or an inkjet type or offset printing type image forming unit may be used.

Image Reading Apparatus

Figure 2:
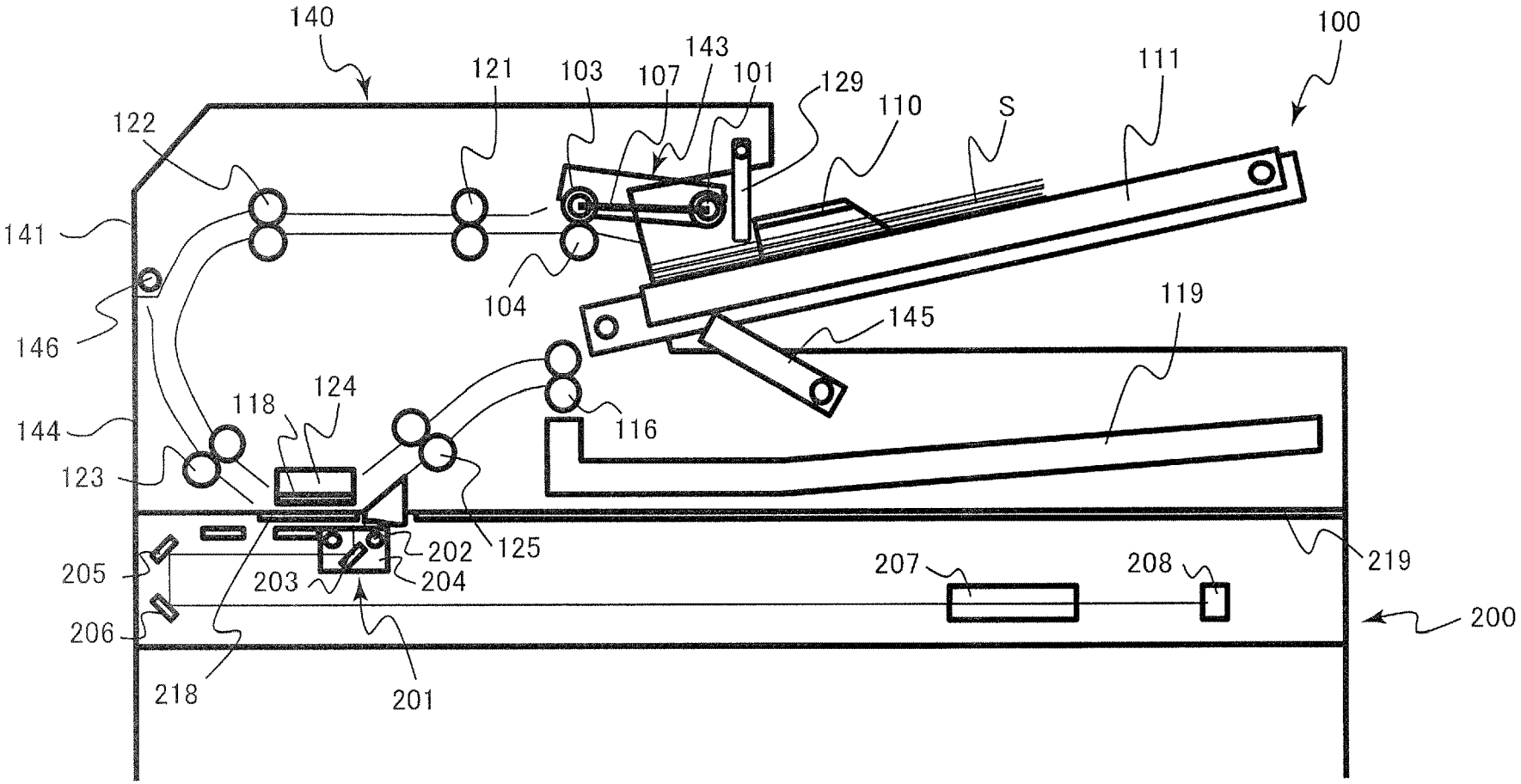
FIG. 2 is a schematic diagram of an image reading apparatus.

The ADF 100 serving as a sheet feeding apparatus of the present embodiment and the image reading unit 200 constituting the image reading apparatus of the present embodiment together with the ADF 100 will be described with reference to FIG. 2.

The image reading unit 200 includes a platen glass 218, a document glass 219, and a reading unit 201. The reading unit 201 is what a lump 202 and a mirror 203 are mounted on a carriage 204 movable in a sub-scanning direction (in a right-left direction in FIG. 2) under the document glass 219. The lump 202 is a light source illuminating light to an image surface on the document S. Reflection light from the document S is lead to an image forming lens 207 through mirrors 203, 205 and 206 to form an image on a charge coupled device 208 serving as an image sensor. The charge coupled device 208 converts the incoming light into electronic image information by performing photoelectric conversion.

The reading unit 201 of the image reading unit 200 can perform an image reading operation by two modes of document fixed-reading and document feeding-reading. The document fixed-reading is an operation of reading image information from a stationary document stationary placed on the document glass 219 while moving the reading unit 201 in the sub-scanning direction. The document feeding-reading is an operation of reading image information from one sheet surface of a moving document conveyed by the ADF 100 in a condition in which the reading unit 201 is positioned under the platen glass 218.

The ADF 100 includes a reading unit 124, a document tray 111, a sheet feed unit 143, a registration roller pair 121, conveyance roller pairs 122, 123 and 125, a discharge roller pair 116, and a discharge tray 119.

The reading unit 124 reads image information from another sheet surface of the moving document conveyed by the ADF 100. That is, both of the reading unit 201 of the image reading unit 200 and the reading unit 124 of the ADF 100 are examples of image reading portions configured to read image information from a sheet. In the present embodiment, a contact image sensor is used as the reading unit 124, and a lamp serving as a light source, a lens array constituting a non-magnification optical system and an image sensor such as CMOS are disposed in the reading unit 124.

The document S from which an image is to be read is placed on a document tray 111 serving as a sheet stacking portion of the present embodiment. A widthwise position of the document S placed on the document tray 111 is regulated by side regulating plates 110 movable in a width direction. Still further, an under surface of the document tray 111 is supported by a lift plate 145 which is one example of a lift portion. The lift plate 145 lifts up and lifts down the document tray 111 by being driven and pivoted by a tray lifting motor 181 (see FIG. 3) serving as a driving source.

The sheet feed unit 143 includes a feed roller 101, a conveyance roller 103, and a separation roller 104. The feed roller 101 is disposed above the document tray 111 and delivers the document S out of the document tray 111. The conveyance roller 103 receives the document S from the feed roller 101 to convey to the registration roller pair 121.

The separation roller 104 is connected through a torque limiter to a fixed shaft and separates the document S by applying a frictional force to the document S entering a separation nip between the conveyance roller 103 and the separation roller 104. In a case where one document S enters the separation nip, the torque limiter slips and the separation roller 104 is rotated following the conveyance roller 103. Meanwhile, in a case where a plurality of documents enter the separation nip, the separation roller 104 does not rotate and stops conveyance of the sheet other than an uppermost sheet in contact with the conveyance roller 103. The separation roller 104 is just one example of a separation member, and a retard roller to which a rotation in a direction opposite to the conveyance direction of the sheet is inputted through the torque limiter or a pad-like friction member may be used.

The document S that has passed through the separation nip is caused to butt against the registration roller pair 121 being stopped to correct a skew thereof and is then conveyed to the reading unit 124 by the registration roller pair 121 and the conveyance roller pairs 122 and 123 through a conveyance path curved into a shape of a character U. Then, as the document S passes through between the platen glasses 118 and 218 of the reading unit 124 and of the image reading unit 200, the image information is read by the reading units 124 and 204 from one or the other surface of the document S. After that, the document S is passed to a discharge roller pair 116 through a conveyance roller pair 125 and is discharged by the discharge roller pair 116 to a discharge tray 119.

Control System

Figure 3:
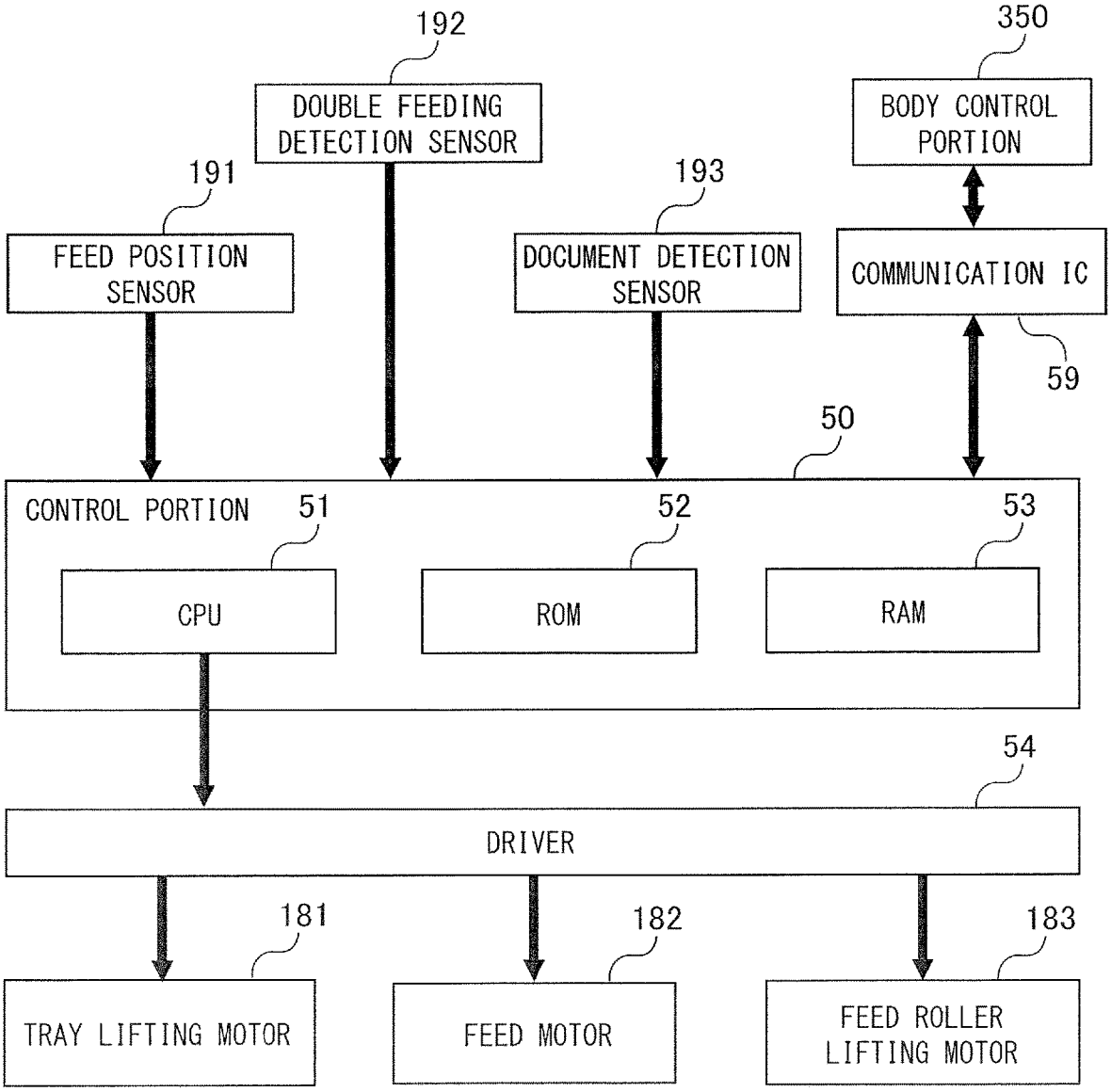
FIG. 3 is a block diagram illustrating a control system of an ADF.

A configuration of a control portion 50 for controlling the ADF 100 will be described with reference to FIG. 3. The control portion 50 for controlling the ADF 100 is constituted of a control circuit including at least one processor. The control portion 50 serving as a control portion of the present embodiment includes a central processing unit (CPU) 51, a read only memory (ROM) 52 which is an exemplary non-volatile storage medium, and a random access memory (RAM) 53 which is an exemplary volatile storage medium. The CPU 51 reads out and executes a program stored in the ROM 52 or the like and controls operations of the ADF 100 and of the image reading unit 200. The RAM 53 becomes a workspace when the CPU 51 executes the program. Note that each function of the control portion 50 described below may be mounted on a circuit of the control portion as an independent hardware such as ASIC or may be mounted as software as a function unit of the program executed by the CPU 51 or another processing unit.

The ADF 100 is provided with various sensors for detecting conditions of the apparatus. A feed position sensor 191 serving as a detection unit of the present embodiment detects that an upper surface of a document stacked on the document tray 111 is located on a level that can be fed by the feed roller 101. A double feed detecting sensor 192 detects a double feeding condition in which a multiple number of documents enter the separation nip. Specifically, a sensor configured to detect a document between the separation nip and the registration roller pair 121 may be used as the double feed detecting sensor 192. A document detection sensor 193 detects whether a document is present on the document tray 111. A photoelectric sensor or a photo-interrupter that is shaded by a flag that swings by being pressed by a document may be used as the respective sensors 191 through 193. For instance, the document detection sensor 193 is disposed so as to be shaded when a document detecting flag 129 (see FIG. 2) pivots by being pressed by the document S.

The CPU 51 controls an operation of each of motors 181 through 183 which are driving sources of the ADF 100 by issuing a drive command to a driver 54. The tray lifting motor 181 drives the abovementioned lift plate 145. The feed motor 182 drives the feed roller 101 and the conveyance roller 103 of the sheet feed unit 143. The feed roller lifting motor 183 can move the feed roller 101 between a position where the feed roller 101 can come into contact with a document stacked on the document tray 111 and a position set back so as not to come into contact with the document. In the present embodiment, stepping motors are used for these motors 181 through 183. The CPU 51 can control rotation amounts and rotational speeds of the motors by specifying a number of pulses and frequency of exciting pulses transmitted from the driver 54 to each of the motors 181 through 183. The driver 54 can also rotate each of the motors 181 through 183 in an inverse direction.

The control portion 50 is connected with a body control portion 350 mounted in the image forming unit 301 through a communication IC 59. The body control portion 350 is constituted of a control circuit having at least one processor and controls the image forming operation of the electrophotographic unit 10 and the conveyance operation of the sheet P serving as the recording medium. The body control portion 350 also executes a job of receiving image information read by the image reading apparatus and of forming a copy image on the sheet P based on the image information. The body control portion 350 also functions as a control portion integrally controlling the image forming apparatus 300. For instance, the body control portion 350 controls the operation of the image reading apparatus by issuing a command to the control portion 50 based on an instruction given from a user through an operating portion.

Figure 4:
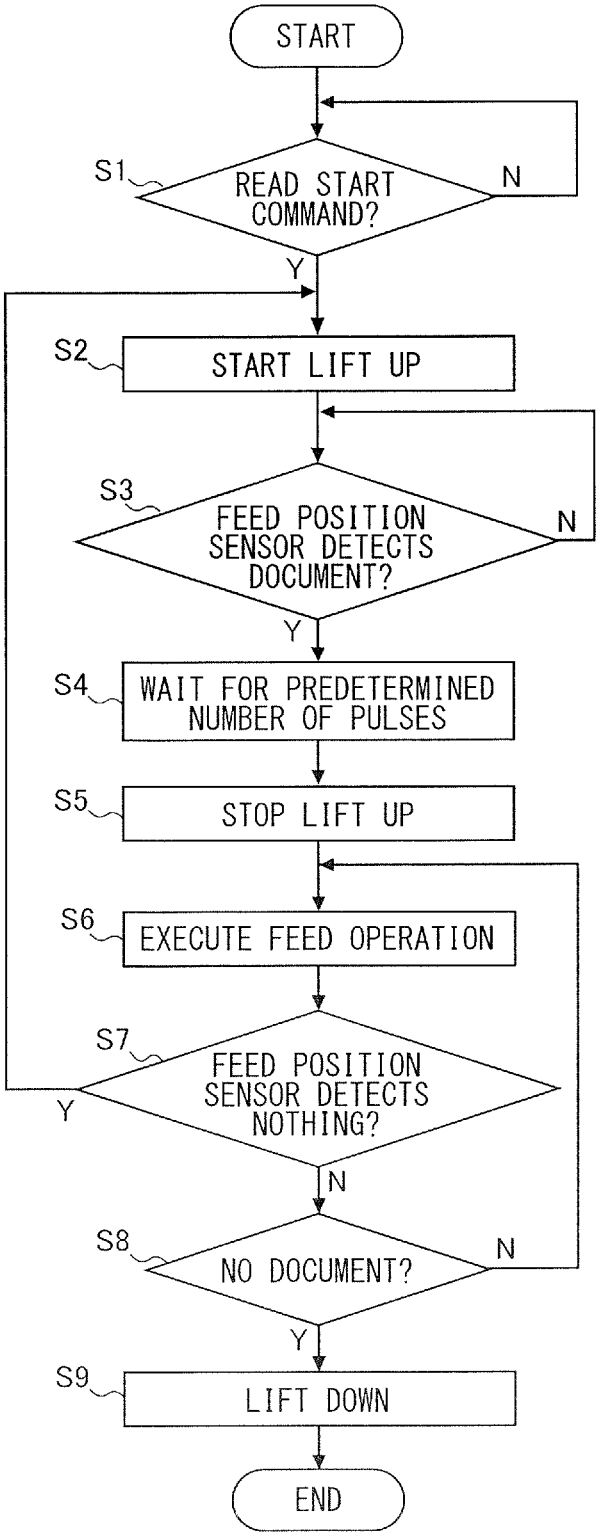
FIG. 4 is a flowchart illustrating a control method of a document feed operation.

FIG. 4 is a flowchart indicating a method for controlling a document feed operation of the ADF 100. As a command signal, e.g., a read start command, commanding to read image information is issued from the body control portion 350 to the control portion 50, i.e., Yes in Step S1, the CPU 51 starts to lift up the document tray 111 in Step S2. That is, the CPU 51 issues a drive command of instructing to start to drive the tray lifting motor 181 to the driver 54, and the driver 54 transmits the excitation pulse to the tray lifting motor 181 to rotate the tray lifting motor 181. Thereby, the lift plate 145 pivots and lifts up the document tray 111.

As the upper surface of the documents stacked on the document tray 111 comes into contact with the feed roller 101 and an arm 102 (see FIG. 6) is lifted up, a part of the arm 102, i.e., a flag portion 190 described later, shades the feed position sensor 191, i.e., Yes in Step S3. That is, the feed position sensor 191 detects that the upper surface of the documents has reached a predetermined level (referred to as a 'detection position' of the feed position sensor 191 hereinafter). After detecting the document by the feed position sensor 191, the tray lifting motor 181 is continuously driven by a predetermined number of pulses in Step S4 and is then stopped in Step S5.

As the lift up operation of the document tray 111 ends, the feed motor 182 is started to be driven to deliver the documents out of the document tray 111 and to start to feed the documents by the feed roller 101 in Step S6. If a number of the documents on the tray is reduced as the documents are fed, there is a case where the feed position sensor 191 is switched to a state of detecting no document because the positions of the feed roller 101 and the arm 102 drop, i.e., Yes in Step S7. In this case, the process is returned to Step S2 to start to drive the tray lifting motor 181 again to lift up the document tray 111 to an upper position by a predetermined number of pulses, i.e., by a predetermined distance, from the detection position, and feeding of the documents is continued. As the document detection sensor 193 detects that no document is left on the tray, i.e., Yes in Step S8, the CPU 51 rotates the tray lifting motor 181 in the inverse direction to lift down the document tray 111 in Step S9 and ends the process.

In the control method described above, the lift up operation of the document tray 111 is continued by the predetermined number of pulses even if the upper surface of the documents exceeds the detection position of the feed position sensor 191 to reduce noise of the ADF 100. That is, if the lift up operation of the document tray 111 is finished right after the feed position sensor 191 detects the documents, the lift up operation of the document tray 111 is repeated every time when a small number of documents is fed and noise of the motor and moving sound of the tray are generated. In contrast, even if the position of the upper surface of the document has been slightly changed, it is still possible to continue the feed operation without any problem if a width of the change of the feed roller 101 is small to a degree not affecting the feed operation. Accordingly, it is possible to reduce the noise by lifting up the document tray 111 upward by a certain distance from the detection position of the feed position sensor 191.

Sheet Feed Unit

Figure 5:
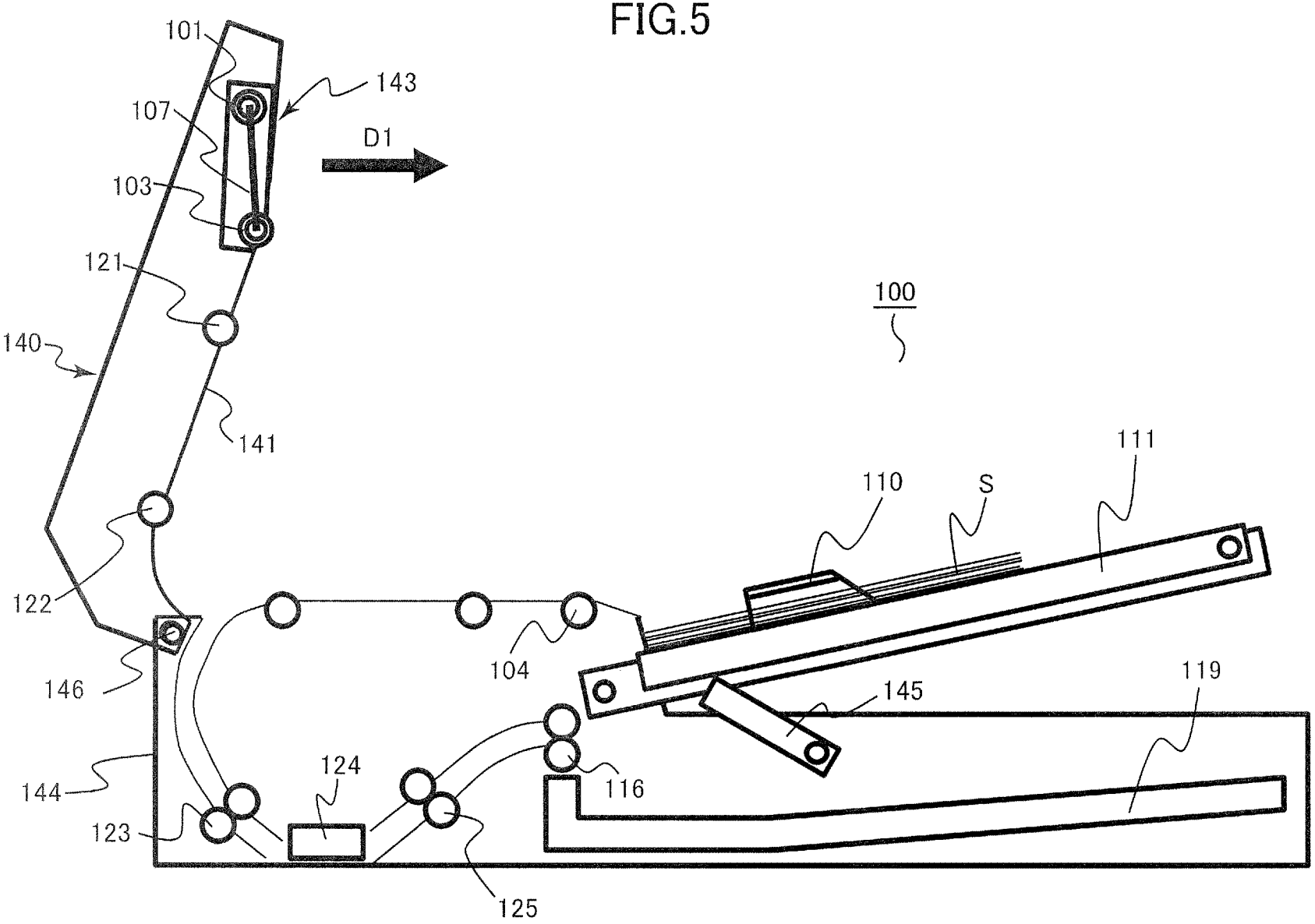
FIG. 5 is a schematic diagram of the image reading apparatus in a condition in which a cover unit is opened.

A configuration of the sheet feed unit 143 of the ADF 100 will be detailed below with reference to FIGS. 5 through 9. FIG. 5 illustrates a state in which the cover unit 140 by which the sheet feed unit 143 is supported is opened. A cover body 141 of the cover unit 140 serving as a cover member of the present embodiment is supported by a frame 144 of the ADF 100 through a pivot shaft 146 and is opened and closed by pivoting on the pivot shaft 146. The cover unit 140 is provided with rollers of one side of the sheet feed unit 143, the registration roller pair 121 and the conveyance roller pair 122 as well as a guide forming a conveyance path of the document. The cover unit 140 is opened in a case of replacing or cleaning the sheet feed unit 143 or in a case of removing a document jammed within the ADF 100. It is possible to keep the state in which the cover unit 140 is opened with a predetermined angle by a stopper, and it is also possible to remove the sheet feed unit 143 out of the cover body 141 in a direction indicated by an arrow D1 in FIG. 5.

Figure 6:
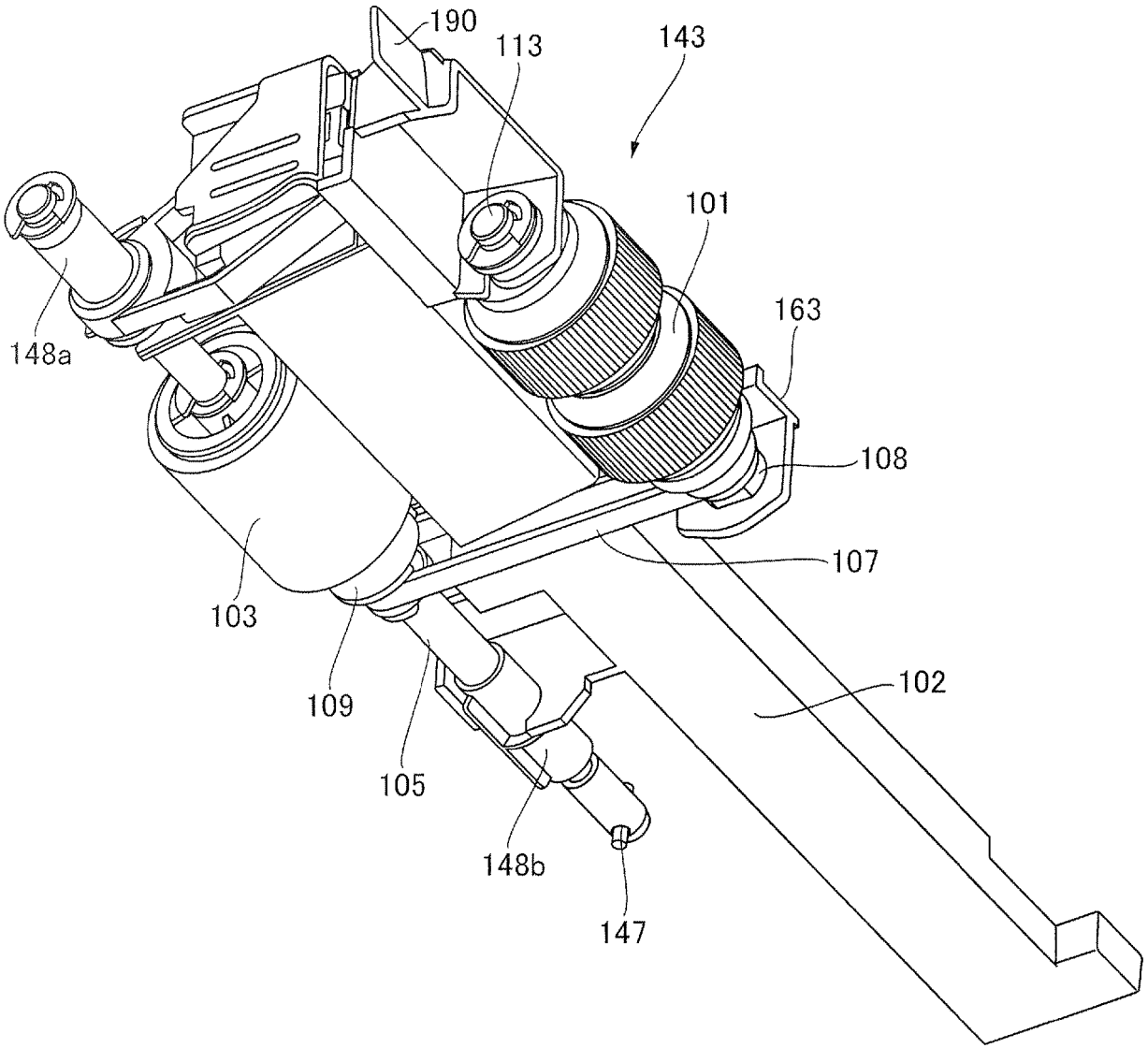
FIG. 6 is a perspective view illustrating a sheet feeding unit of the ADF.

FIG. 6 is a perspective view of the sheet feed unit 143. A feed roller 101 serving as a feed member of the present embodiment is supported by a shaft 113 attached to the arm 102. The arm 102 serving as a holding member of the present embodiment is capable of pivoting so as to move the feed roller 101 up and down, in a state in which the cover unit 140 is closed, centering on a shaft 105 holding a conveyance roller 103. The feed roller 101 and the conveyance roller 103 are connected through pulleys 108 and 109 and a timing belt 107 stretched around these pulleys 108 and 109. The shaft 105 is also provided with a pin 147 for inputting a driving force at an end portion thereof. Rotation inputted to the shaft 105 through the pin 147 is distributed to the feed roller 101 and the conveyance roller 103. Note that the belt driving mechanism including the timing belt 107 is one example of a transmission mechanism, and the shaft 105 may be connected with the feed roller 101 through a gear train held by the arm 102 for example.

Bearing portions 148*a* and 148*b* are fitted around the shaft 105 on both sides of the conveyance roller 103 in an axial direction of the shaft 105. The arm 102 is also provided with the flag portion 190 configured to shade the feed position sensor 191 and a pressing portion 163 pressed by a lever member described later.

Figure 7:
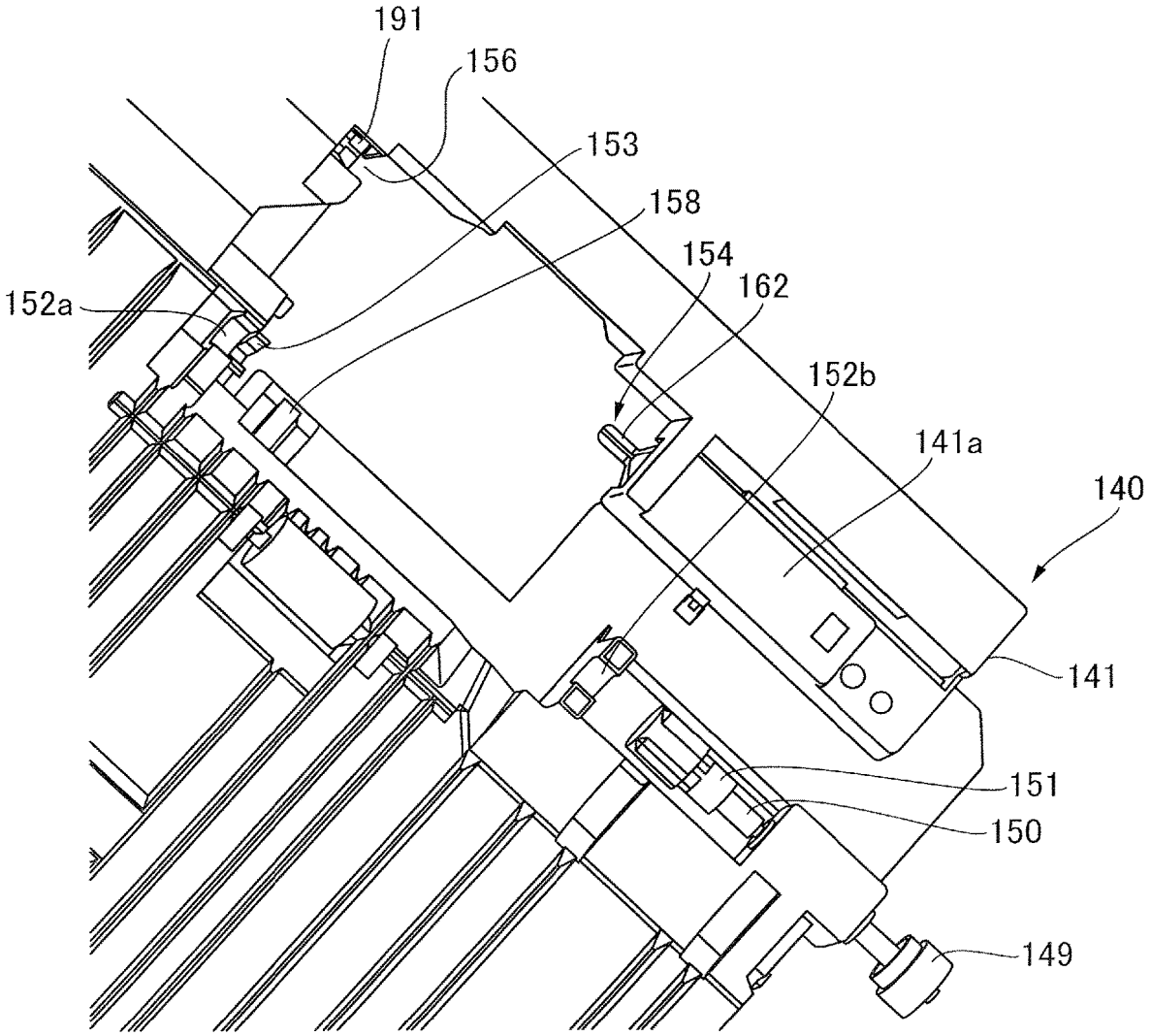
FIG. 7 is a perspective view illustrating the cover unit from which the sheet feeding unit is removed.

FIG. 7 is a perspective view illustrating the cover unit 140 in the state in which the sheet feed unit 143 is removed, i.e., the cover unit 140 viewed from downstream of the arrow D1 in FIG. 5. The driving shaft 150 transmitting the driving force to the sheet feed unit 143 is held in the cover body 141. An input gear 149 is attached at a first end of the driving shaft 150 and a coupling 151 is provided at a second end of the driving shaft 150. The cover body 141 is provided with positioning grooves 152*a* and 152*b* corresponding to the bearing portions 148*a* and 148*b* of the sheet feed unit 143. A resin made unit holding portion 153 is also provided at a position corresponding to the bearing portion 148*a* and a recess portion 156 for accommodating the flag portion 190 of the arm 102 is provided near the feed position sensor 191.

Figure 8:
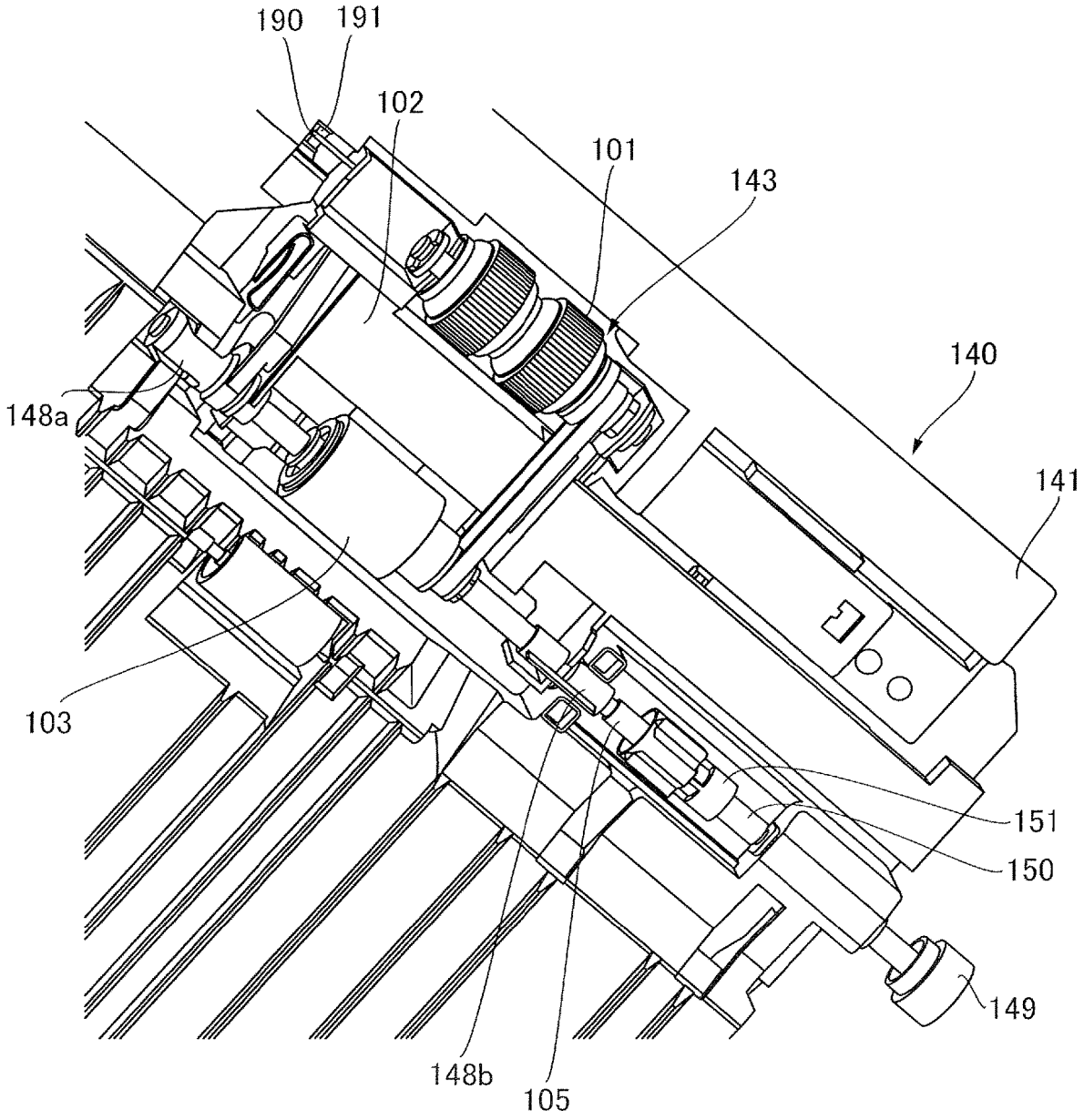
FIG. 8 is a perspective view illustrating the cover unit to which the sheet feeding unit is attached.

In attaching the sheet feed unit 143 to the cover unit 140, the shaft 105 is inserted into the coupling 151 such that the pin 147 is accommodated in a predetermined position and the bearing portion 148*a* is fitted into the unit holding portion 153 by deflecting the unit holding portion 153 as illustrated in FIG. 8. In this operation, because the bearing portions 148*a* and 148*b* of the sheet feed unit 143 engage with the positioning grooves 152*a* and 152*b* of the cover unit 140, a position in terms of the sheet feeding direction of the sheet feed unit 143 is determined. Still further, the flag portion 190 of the arm 102 is stored in the recess portion 156.

Figure 9:
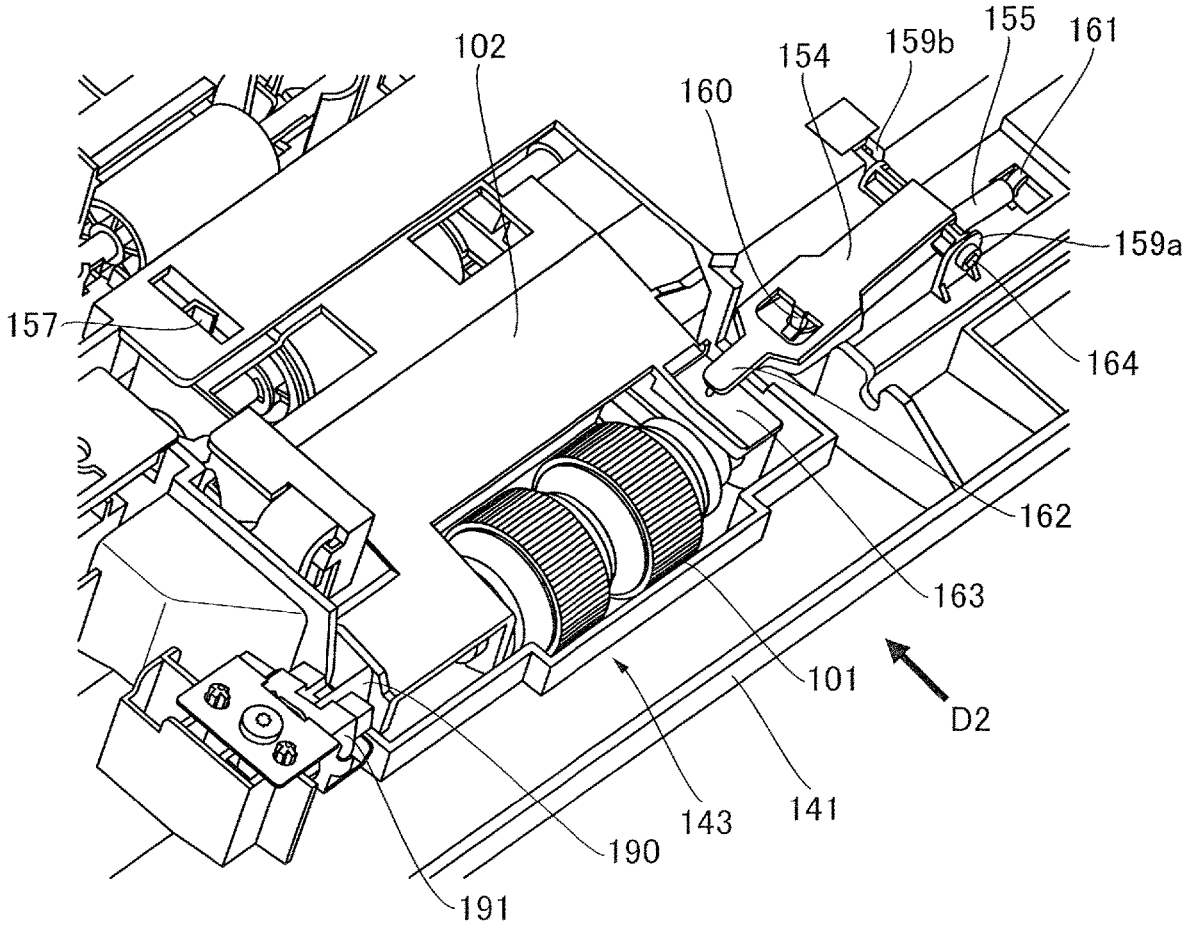
FIG. 9 is a perspective view illustrating the cover unit to which the sheet feeding unit is attached and which is viewed from another direction.

Note that a position in an axial direction of the sheet feed unit 143 in the attached state, i.e., a widthwise position of the document, is determined as the projecting portion 157 provided in the arm 102 engages with an opening portion 158 of the cover body 141 as illustrated in FIG. 9. The projecting portion 157 and the opening portion 158 serves as a stopper limiting a pivot range of the arm 102. Here, FIG. 9 illustrates a state of the cover unit 140, attached with the sheet feed unit 143, viewed from a back side of FIG. 8, while omitting to illustrate a part of the cover body 141.

If the cover unit 140 is closed in a condition in which the sheet feed unit 143 is attached to the cover body 141, the conveyance roller 103 comes into contact with and presses the separation roller 104. Then, the bearing portions 148*a* and 148*b* of the sheet feed unit 143 butt against deepest portions of the positioning grooves 152*a* and 152*b* of the cover body 141 and thus a position of the sheet feed unit 143 in a height direction is determined.

Pressurizing Lever

Here, an arrangement for pressurizing the feed roller 101 to the document will be described. According to the present embodiment, the feed roller 101 is brought into pressure contact with the document stacked on the document tray 111 by pressing the arm 102 by a pressurizing lever 154 connected with a pressurizing spring 155 as illustrated in FIG. 9. In other words, the arrangement is made such that an urging force of the pressurizing spring 155 which is an exemplary elastic member does not act directly on the arm 102 holding the feed roller 101 but acts through the pressurizing lever 154 which is an exemplary lever member.

As illustrated in FIG. 7, the pressurizing lever 154 and the pressurizing spring 155 are held by the cover body 141 and are left in the cover unit 140 even if the sheet feed unit 143 is removed. This arrangement is advantageous in that it facilitates replacement works as compared to an arrangement which requires attachment and detachment works of the spring member directly connected to the arm 102 in replacing the sheet feed unit 143 for example. Still further, the pressurizing lever 154 and the pressurizing spring 155 are covered by a protection plate 141*a* as a cover portion of the cover body 141 such that only an edge portion 162 of the pressurizing lever 154, which is a contact portion of the pressurizing lever 154 with the arm 102, is exposed.

As illustrated in FIG. 9, the pressurizing lever 154 is held by lever holding portions 159*a* and 159*b* of the cover body 141 through a pivot shaft 164 and pivots on the pivot shaft 164. The pivot shaft 164 extends in parallel with a feed direction D2 of the document fed by the feed roller 101 when viewed in a thickness direction of the document fed by the feed roller 101, i.e., approximately in a vertical direction, in the state in which the cover unit 140 is closed. The pressurizing lever 154 extends in a direction intersecting with the feed direction D2 from the pivot shaft 164, i.e., in the width direction of the document in particular, and is in contact with the pressing portion 163 of the arm 102 at the edge portion 162. The contact position of the edge portion 162 with the pressing portion 163 in terms of the feed direction D2 overlaps with an occupying range of the feed roller 101 in terms of the feed direction D2.

Figure 10:
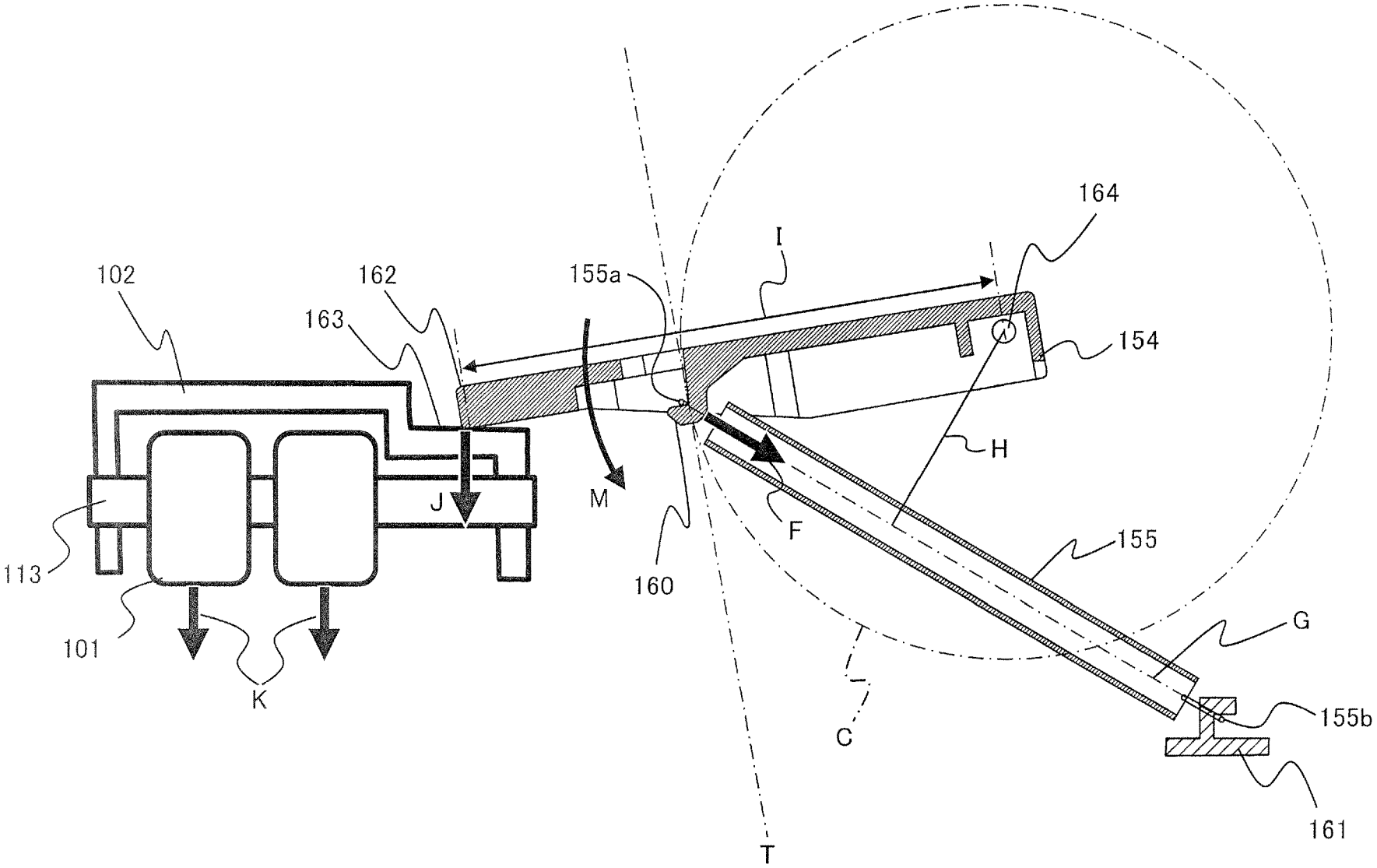
FIG. 10 illustrates positioning of a pressurizing spring.

As illustrated in FIG. 10, the pressurizing spring 155 of the present embodiment is a tensile coil spring, and one end thereof, i.e., a free end 155*a*, is attached to a lever side attachment portion 160 of the pressurizing lever 154 and another end, i.e., a fixed end 155*b*, is attached to a cover side attachment portion 161 of the cover body 141. A contact portion of the free end 155*a* with the lever side attachment portion 160 is a point of action of force acting from the pressurizing spring 155 on the pressurizing lever 154 and moves along a circular arc centering on the pivot shaft 164 along with a pivotal motion of the pressurizing lever 154. Meanwhile, the fixed end 155*b* is fixed to the cover body 141 constituting a casing of the ADF 100 together with the frame 144. A distance between the free end 155*a* and the fixed end 155*b* is a length of the pressurizing spring 155.

The pressurizing spring 155 urges the arm 102 downward through the pressurizing lever 154 by pulling the pressurizing lever 154 in a direction of pressing the arm 102 downward, i.e., counterclockwise in FIG. 10. The pressurizing spring 155 also has the function of dispersing a bound of the feed roller 101, caused by an impact when the feed roller 101 comes into contact with the upper surface of the document, by friction at the contact portions with the attachment portions 160 and 161 and of stabilizing a pressurizing force quickly to be ready for a start of the feed operation. The pressurizing force of the feed roller 101 to the document is mainly determined by a force of the pressurizing lever 154 pressing the arm 102 downward and a gravity acting on the sheet feed unit 143 by a weight of the feed roller 101, the arm 102 and others. The pressurizing force of the feed roller 101 is set such that it falls within a range of 140 gf to 160 gf for example.

A lower limit value of the pressurizing force is determined by considering a response capability to an upwardly bent document. The upwardly bent document is a sheet or a document in a condition in which an end portion of the sheet is bent or curved upward and is liable to receive a large conveyance resistance as compared to that in a normal case by coming in contact with the guide and others at locations other than the feed roller 101. If the pressurizing force of the feed roller 101 is insufficient, a frictional force generated between the feed roller 101 and the document becomes smaller than the conveyance resistance received by the document and the feed roller 101 is liable to slip, leading to a feeding failure.

Meanwhile, an upper limit value of the pressurizing force is determined such that the document is not damaged. If the pressurizing force is too high, an underlying document, i.e., a next document, of the uppermost document in contact with the feed roller 101 is also moved toward the separation nip, and the next document is deflected between the separation nip and the feed roller 101. After that, as a succeeding document is fed, the deflected part of the document is squashed by the separation nip and is buckled, thus damaging the document. Because such damage is liable to occur in a case where the document is a sheet member having low rigidity such as a thin sheet, the upper limit value of the pressurizing force is set so as to be able to avoid such damage of the sheet member softest among sheet members used as the document.

It is noted that the pressing portion 163 of the arm 102 is provided outside of a range overlapping with the feed roller 101 in the axial direction of the feed roller 101 within the upper surface of the arm 102 and is provided at a lower position as compared to the range overlapping with the feed roller 101 on the upper surface of the arm 102. Specifically, it is preferable to provide the pressing portion 163 under an upper end position of the feed roller 101. This arrangement makes it possible to dispose the pressurizing lever 154 comfortably within the cover body 141, i.e., around a ceiling of the ADF 100, because a vertical range occupied by the pressurizing lever 154 and the sheet feed unit 143 is reduced.

In terms of the sheet feeding direction, the contact position of the pressing portion 163 with the pressurizing lever 154 overlaps with the position of the feed roller 101, i.e., with a range from an upstream end position to a downstream end position of the feed roller 101 in the sheet feed direction. Still further, in terms of the axial direction of the feed roller 101, it is preferable to dispose the contact position of the pressing portion 163 with the pressurizing lever 154 at a position close to the feed roller 101 as much as possible. If the contact position is distant from the feed roller 101, it is concerned that the arm 102 might be deformed and a contact pressure to the document of the feed roller 101 becomes uneven. These features contribute in stabilizing the contact pressure.

Positioning of Pressurizing Spring

Here, positioning of the pressurizing lever 154 and the pressurizing lever 154 for suppressing fluctuation of the pressurizing force of the feed roller 101 will be described. FIG. 10 illustrates a positional relationship among the pressurizing lever 154, the pressurizing spring 155, and the arm 102 when viewed from the axial direction of the pivot shaft 164 of the pressurizing lever 154.

Among elements determining a magnitude of the pressurizing force K of the feed roller 101 to the document S, a gravity generated by own weight of the feed roller 101 and others is approximately constant. Meanwhile, a degree of a pressing force J by which the pressurizing lever 154 presses the arm 102 may fluctuate corresponding to an angle of the pressurizing lever 154.

The following relationship holds in terms of the pressing force J:

$$M=J\blacksquare I=F\blacksquare H \qquad \text{eq. 1}$$

Where, the sign M denotes a counterclockwise moment in FIG. 10 acting on the pressurizing lever 154 by a restoring force F of the pressurizing spring 155. The sign I denotes a distance from a pivot axis of the pressurizing lever 154 to the contact position of the pressurizing lever 154 with the arm 102. The sign H denotes a distance from the pivot axis of the pressurizing lever 154 to a line of action G of the restoring force F, i.e., a length of an arm of the moment M. The line of action G of the restoring force F is a straight line drawn in a direction of the restoring force F via the free end 155*a* of the pressurizing spring 155.

The equation 1 may be rewritten as follows:

$$J=F\blacksquare H/I \qquad \text{eq. 2}$$

As it is apparent from the above equation, it is important to arrange such that a change of the moment M (=F■H) to the pivotal motion of the pressurizing lever 154 is reduced in order to suppress the fluctuation of the pressing force J.

The change of the moment M when the feed roller 101 is displaced up and down will be considered as described below based on a condition in which the feed roller 101 is located at a predetermined position where the feed roller 101 can feed the document, i.e., at a target position set in advance for performing sheet feeding properly. The target position of the present embodiment refers to a position set in advance between the detection position of the feed position sensor 191 and a position where the lift up operation is finished, i.e., a position lifted up by a predetermined number of pulses from the detection position. In other words, a value of the abovementioned predetermined number of pulses at the detection position of the feed position sensor 191 and in the feed operation is set corresponding to the target position set in advance.

If the feed roller 101 is displaced above the target position, the restoring force F of the pressurizing spring 155 increases as compared to a case where the feed roller 101 is located at the target position. Meanwhile, if the feed roller 101 is displaced below the target position, the restoring force F of the pressurizing spring 155 decreases as compared to the case where the feed roller 101 is located at the target position. Accordingly, it is possible to suppress the change of the moment M when the feed roller 101 is displaced from the target position by positioning the pressurizing spring 155 so as to cancel the change of the restoring force F.

Figure 11A:
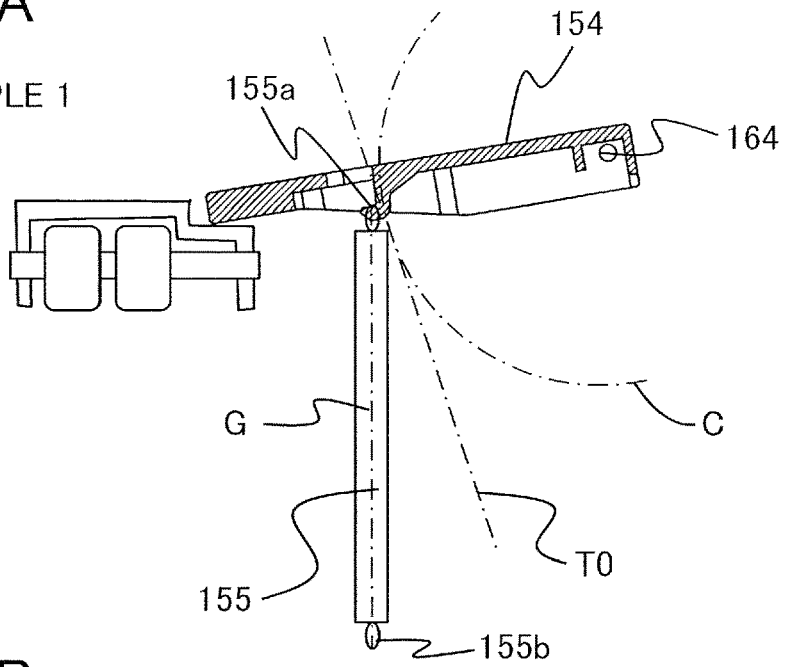
FIG. 11A illustrates a first positioning example of the pressurizing spring.
Figure 11B:
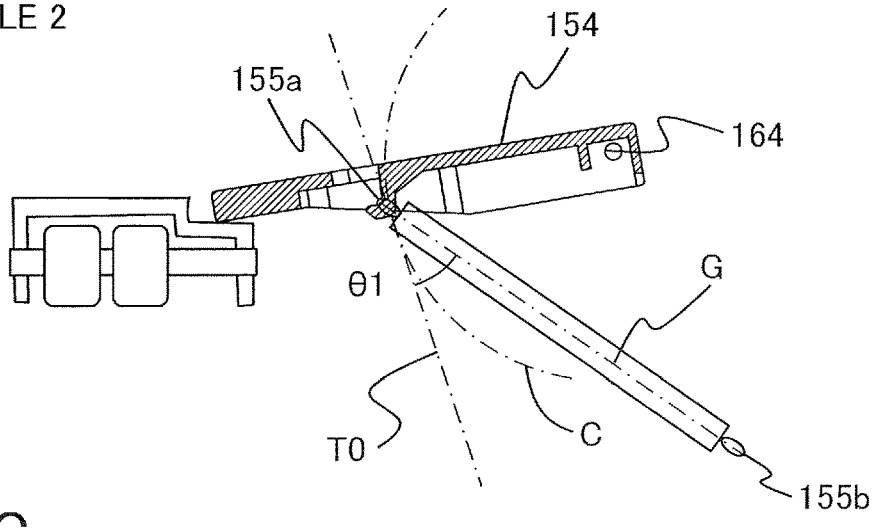
FIG. 11B illustrates a second positioning example of the pressurizing spring.
Figure 11C:
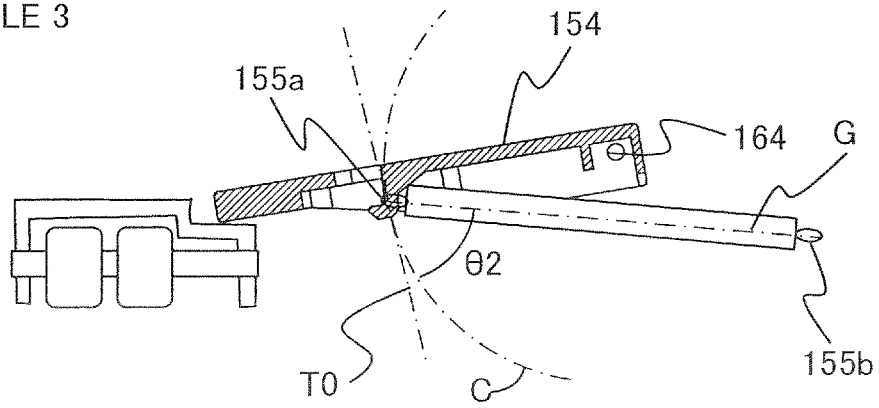
FIG. 11C illustrates a third positioning example of the pressurizing spring.

FIGS. 11A through 11C illustrate conditions related to positioning of the pressurizing spring 155. In the disposition of the pressurizing spring 155 indicated in FIG. 11A, i.e., in a first example, the fixed end 155*b* is located on a side opposite to the pivot shaft 164 of the pressurizing lever 154 with respect to a reference line T0. Here, the reference line T0 is a tangential line, passing through a position of the lever side attachment portion 160 in a case where the feed roller 101 is located at the target position, of a circle C drawn by the lever side attachment portion 160 along with the pivotal motion of the pressurizing lever 154. In the positioning examples in FIGS. 11B and 11C, i.e., in second and third examples, the fixed end 155*b* is located on the same side with the pivot shaft 164 of the pressurizing lever 154 with respect to the reference line T0. Here, the fixed end 155*b* is located differently and values of angles θ1 and θ2 formed between the reference line T0 and the line of action G of the restoring force F are different in the second and third examples ($\theta<\theta 1<\theta 2<\pi/2$).

FIGS. 12A through 12I are graphs indicating results obtained by calculating a length L of the pressurizing spring 155, the distance H from the pivot shaft 164 to the line of action G of the restoring force F and the pressing force J of the pressurizing lever 154 when the feed roller 101 is displaced from the target position on the assumptions of the first through third positioning examples. A column of (FIGS. 12A, 12D and 12G) corresponds to the first example in FIG. 11A, a column of (FIGS. 12B, 12E and 12H) corresponds to the second example in FIG. 11B and a column of (FIGS. 12C, 12F and 12I) corresponds to the third example in FIG. 11C. Axes of abscissa of the respective graphs are common and indicate displacements (unit in mm) of the feed roller 101 with respect to the target position such that an upward displacement is indicated by a positive sign. The length L of the pressurizing spring 155 is a sum of a natural length L0 and an elongation L1 (L=L0+L1).

Here, a target value of the pressurizing force K of the feed roller 101 applied to the document is assumed to be 150 gf and a pressurizing force generated by own weight of the feed roller 101 and others is assumed to be 65 gf. Accordingly, it is preferable to keep the pressing force J of the pressurizing lever 154 to a value close to 85 gf.

Figure 12A:
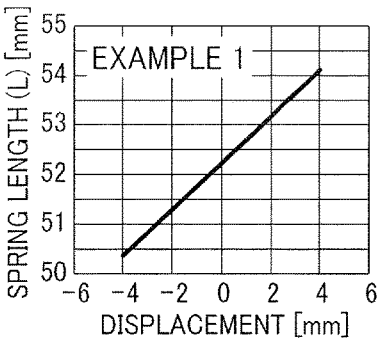
FIG. 12A is a graph illustrating changes of the pressurizing force with respect to displacement of the feed roller in the first positioning example in FIG. 11A.
Figure 12B:
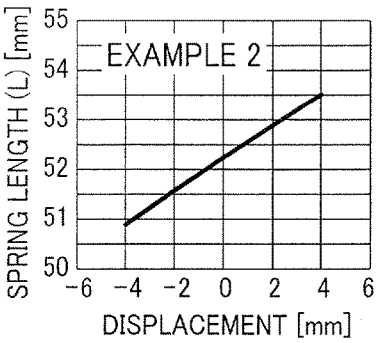
FIG. 12B is a graph illustrating changes of the pressurizing force with respect to displacement of the feed roller in the second positioning example in FIG. 11B.
Figure 12C:
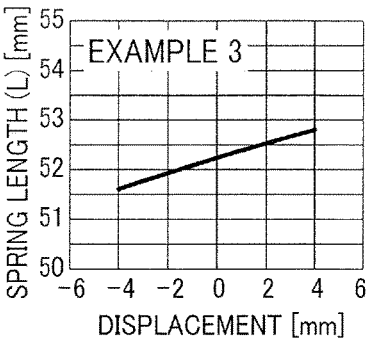
FIG. 12C is a graph illustrating changes of the pressurizing force with respect to displacement of the feed roller in the third positioning example in FIG. 11C.

If the feed roller 101 is displaced upward from the target position, the elongation of the pressurizing spring 155 increases and the length L increases and if the feed roller 101 is displaced downward from the target position, the elongation of the pressurizing spring 155 decreases and the length L decreases in common in the first through third examples in FIGS. 12A through 12C. That is, if the feed roller 101 is displaced upward from the target position, the restoring force F of the pressurizing spring 155 increases and if the feed roller 101 is displaced downward from the target position, the restoring force F of the pressurizing spring 155 decreases.

Figure 12D:
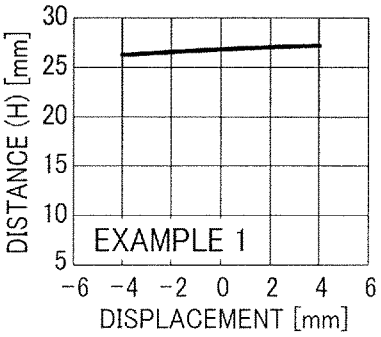
FIG. 12D is a graph illustrating changes of the pressurizing force with respect to displacement of the feed roller in the first positioning example in FIG. 11A.

In the first example, whether the distance H increases or decreases with respect to the displacement of the feed roller 101 coincides with whether the length L of the pressurizing spring 155 increases or decreases (see FIG. 12D). Then, because the pressing force J is proportional to a product of the restoring force F and the distance H as indicated by equation 2, the change of the distance H with respect to the displacement of the feed roller 101 acts in a direction of increasing a fluctuation width of the pressing force J with respect to the displacement of the feed roller 101. As indicated in FIG. 12G, the pressing force J fluctuated with a width of around ±11 gf during when the feed roller 101 is displaced by ±4 [mm] from the target position in the arrangement of the first example.

Figure 12E:
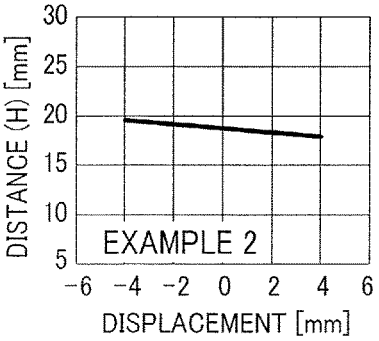
FIG. 12E is a graph illustrating changes of the pressurizing force with respect to displacement of the feed roller in the second positioning example in FIG. 11B.
Figure 12F:
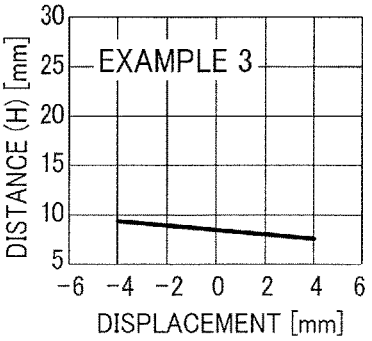
FIG. 12F is a graph illustrating changes of the pressurizing force with respect to displacement of the feed roller in the third positioning example in FIG. 11C.
Figure 12G:
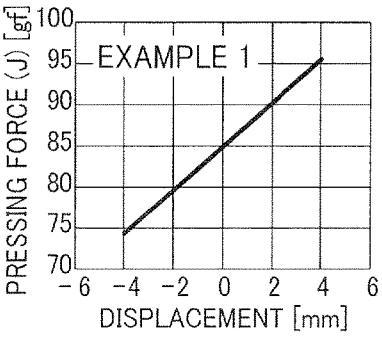
FIG. 12G is a graph illustrating changes of the pressurizing force with respect to displacement of the feed roller in the first positioning example in FIG. 11A.
Figure 12H:
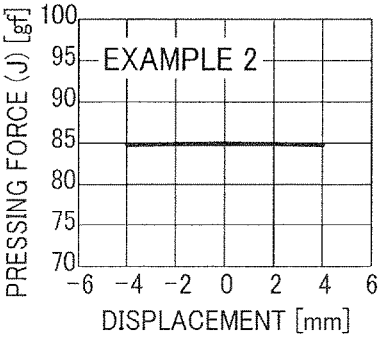
FIG. 12H is a graph illustrating changes of the pressurizing force with respect to displacement of the feed roller in the second positioning example in FIG. 11B.
Figure 12I:
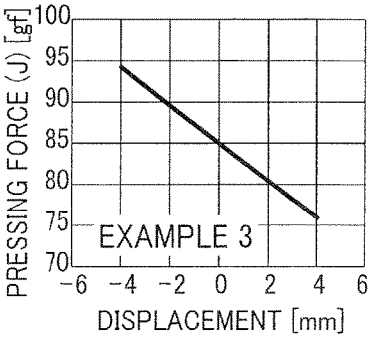
FIG. 12I is a graph illustrating changes of the pressurizing force with respect to displacement of the feed roller in the third positioning example in FIG. 11C.

Meanwhile, in the second and third examples in which the fixed end 155*b* is located on the same side with the pivot shaft 164 with respect to the reference line T0, whether the distance H increases or decreases with respect to the displacement of the feed roller 101 is contrary to whether the length L of the pressurizing spring 155 increases or decreases (see FIGS. 12E and 12F). That is, the distance H decreases if the feed roller 101 is displaced upward from the target position and the distance H increases if the feed roller 101 is displaced downward from the target position. In other words, a distance from the pivot shaft 164 to a line of action G1 in a case where the feed roller 101 is located at a first position, e.g., the target position ±0 mm, is shorter than a distance from the pivot shaft 164 to the line of action G1 in a case where the feed roller 101 is located at a second position, e.g., the target position −2 mm, lower than the first position. Still further, a distance from the pivot shaft 164 to the line of action G1 in the case where the feed roller 101 is located at the first position, e.g., the target position ±0 mm, is longer than a distance from the pivot shaft 164 to the line of action G1 in a case where the feed roller 101 is located at a third position, e.g., the target position +2 mm, above the first position. Such changes of the distance H cancel changes of the restoring force F to the displacement of the feed roller 101 and acts in a direction of suppressing the fluctuation width of the pressing force J. As indicated in FIGS. 12H and 12I, the fluctuation width of the pressing force J during when the feed roller 101 is displaced by ±4 [mm] from the target position in the arrangements of the second and third examples are around ±0.2 gf and ±9 gf, respectively.

The fact that the increase and decrease of the restoring force F is contrary to the increase and decrease of the distance H by positioning the fixed end 155*b* on the same side with the pivot shaft 164 with respect to the reference line T0 can be explained as follows.

Figure 13A:
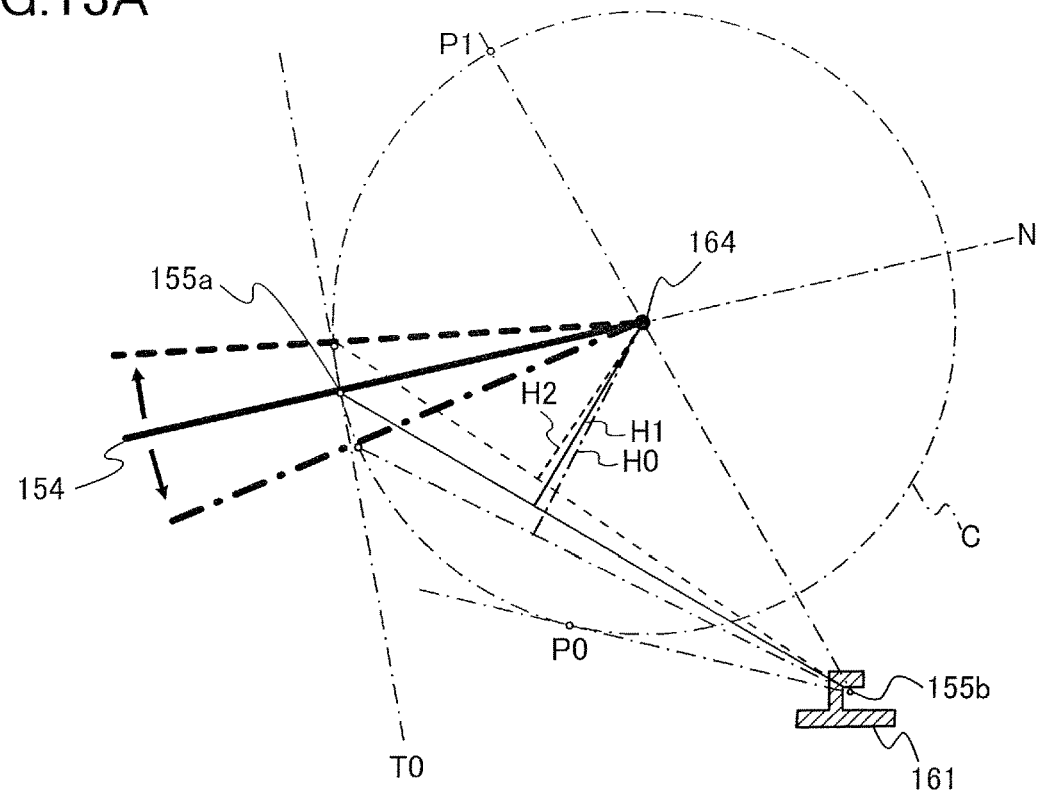
FIG. 13A illustrates a positioning condition of the pressurizing spring.
Figure 13B:
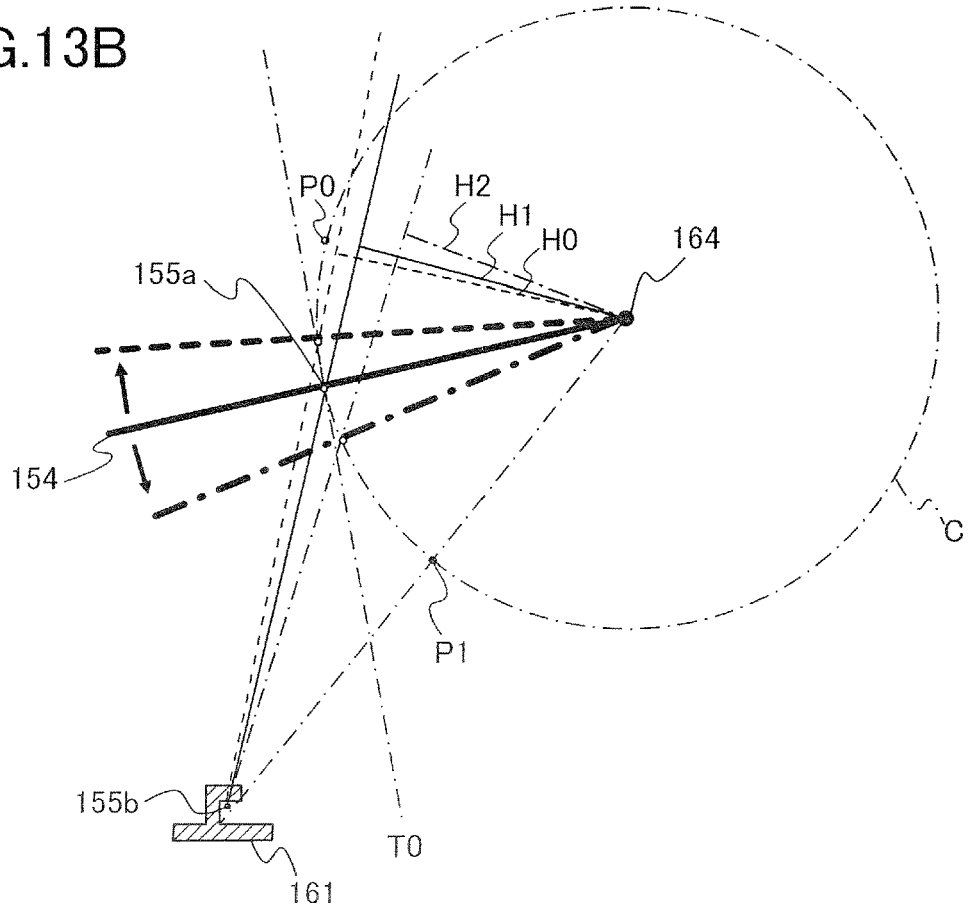
FIG. 13B illustrates another positioning condition of the pressurizing spring.

FIGS. 13A and 13B are schematic diagrams illustrating the changes of the distance H along the pivotal motion of the pressurizing lever 154. FIG. 13A indicates a case where the fixed end 155*b* is located on the same side with the pivot shaft 164 with respect to the reference line T0 and FIG. 13B indicates a case where the fixed end 155*b* is located on the side opposite to the pivot shaft 164 with respect to the reference line T0.

Considering a case by ignoring physical interferences, it can be seen that the distance H from the pivot shaft 164 to the line of action G increases monotonously when the free end 155*a* of the pressurizing spring 155 moves from a point P1 to a point P0 on the circle C in FIG. 13A. Here, the point P1 is a position of the free end 155*a* in a case where the line of action G passes through the pivot axis of the pressurizing lever 154, and the distance H is minimized (H=0) in this case. The point P0 is a position of the free end 155*a* when the line of action G is a tangential line of the circle C, and the distance H, i.e., a distance from the pivot shaft 164 to the free end 155*a* is maximized in this case.

In the positioning in which the fixed end 155*b* is located on the same side with the pivot shaft 164 with respect to the reference line T0, the free end 155*a* in the case where the feed roller 101 is located at the target position is positioned within a part between the point P1 to the point P0. Here, the part between the point P1 to the point P0 refers to a circular arc of the circle C from the point P1 to the point P0 in a direction of urging the feed roller 101 downward, i.e., counterclockwise in FIG. 13A. The fixed end 155*b* is also positioned so as to urge the pressurizing lever 154 in a direction of pressing the arm 102 downward with respect to a straight line N connecting the free end 155*a* and the pivot shaft 164 in the case where the feed roller 101 is located at the target position, i.e., downward in FIG. 13A with respect to the straight line N.

The pressurizing lever 154 when the feed roller 101 is located at the target position is indicated by a solid line, and a value of the distance H from the pivot shaft 164 to the line of action G1 at this time is assumed to be "H1". When the feed roller 101 is displaced downward from the target position and the pressurizing lever 154 moves to a position indicated by a dashed line, the free end 155*a* of the pressurizing spring 155 approaches to the point P0 where the distance H is maximized, the value of the distance H increases (H0>H1). Meanwhile, when the feed roller 101 is displaced upward from the target position and the pressurizing lever 154 moves to a position of a broken line, the free end 155*a* of the pressurizing spring 155 approaches to the point P1 where the distance H is minimized, so that the value of the distance H decreases (H2<H1).

In contrary, in a case where the fixed end 155*b* is located on the side opposite to the pivot shaft 164 with respect to the reference line T0 as illustrated in FIG. 13B, the positional relationship is reversed such that the distance H is minimized at the point P0 and the distance H is maximized at the point P1. That is, if the pressurizing lever 154 pivots counterclockwise in FIG. 13B, the distance H decreases monotonously in contrary to the case illustrated in FIG. 13A. Therefore, when the feed roller 101 is displaced above the target position and the pressurizing lever 154 moves to the position of the broken line, the free end 155*a* of the pressurizing spring 155 approaches to the point P0 where the distance H is maximized and the value of the distance H increases (H0>H1). Meanwhile, when the feed roller 101 is displaced below the target position and the pressurizing lever 154 moves to the position of the dashed line, the free end 155*a* approaches to the point P1 where the distance H is minimized and the value of the distance H decreases (H2<H1). Thus, while the distance H decreases when the feed roller 101 is displaced downward in the configuration of FIG. 13B, the distance H increases when the feed roller 101 is displaced downward in the configuration of the present embodiment illustrated in FIG. 13A. That is, according to the configuration of the present embodiment, in a case where the feed roller 101 is located at a first position, the distance H is smaller than a case where the feed roller 101 is located at a second position below the first position.

Advantages of Present Embodiment

By the way, an elastic member configured to apply a pressurizing force of the feed roller to a sheet, like the pressurizing spring 155, is designed to apply a restoring force corresponding to a pressurizing force of a designed value in a condition in which the feed roller is located at the target position in general. However, due to various factors including a reason related to manufacturing tolerance and a reason related to a control method of a feed operation, there is a case where magnitude of the restoring force actually applied by the elastic member deviates from a target value. If the pressurizing force of the feed roller significantly fluctuates by such fluctuation of the restoring force, there is a possibility of causing a bent sheet and a conveyance failure.

The reason related to the manufacturing tolerance refers to that magnitude of the restoring force is fluctuated by cumulative actions of a tolerance of a member interposed between the feed roller and the elastic member and a tolerance related to a configuration for holding the feed roller and to a sensor configuration for positioning the feed roller to the target position. For instance, tolerances of the respective parts of the document tray 111 and the sheet feed unit 143 of the present embodiment and positioning accuracy of the cover unit 140 and the frame 144 of the ADF 100 are elements that generate a difference in height of the pressing portion 163 in starting the feed operation.

The reason related to the control method of the feed operation refers to that an upper surface of a sheet deviates from the target position while executing the feed operation. As described with reference to FIG. 4, the feed operation of the present embodiment permits the upper surface of the document to fluctuate between the detection position of the feed position sensor 191 and the lift-up finishing position above the detection position. In a conventional configuration, such fluctuation of the restoring force of the elastic member caused along the change of the height of the document is reflected directly to fluctuation of a pressurizing force of the feed roller 101.

Meanwhile, the configurations of the second and third examples of the present embodiment adopt the disposition of the pressurizing spring 155 that cancels the increase and decrease of the restoring force F of the pressurizing spring 155 when the feed roller 101 is displaced from the target position. Thereby, because a change of a product of the restoring force F and the distance H, i.e., F■H (moment M) with respect to the displacement of the feed roller 101 is reduced, the fluctuation of the pressing force J applied to the arm 102 of the pressurizing lever 154 is suppressed. That is, even if a pivot angle of the pressurizing lever 154 fluctuates more or less by the factors related to the manufacturing tolerance and to the control method of the feed operation, it is possible to stabilize the pressurizing force K applied to the document by the feed roller 101 and to realize a stable feed operation. Still further, because the pressurizing force K is automatically adjusted by a mechanical configuration in the present embodiment, it is possible to realize the stable feed operation with a simple configuration as compared to the configuration in which the pressurizing force is controlled by using an actuator such as a cam mechanism.

As illustrated in FIG. 12H, in order to stabilize the pressurizing force K further, it is preferable to arrange such that the product of the restoring force F and the distance H, i.e., F■H, reaches an extremum (which may be a minimum or a maximum) in a case where the feed roller 101 is located between both ends of (i.e., positions other than both ends of) a range in which the feed roller 101 is movable in a normal use condition. The range in which the feed roller 101 is movable in the normal use condition is a range in which the height of the upper surface of the document can fluctuate during the feed operation, i.e., the range from the detection position of the feed position sensor 191 to the lift-up finishing position.

It is also preferable to arrange such that when the feed roller 101 is displaced from the target position, a ratio of (i)

a rate of change of the distance H to (ii) a rate of change of the restoring force F is not less than −2.0 and not greater than −0.5 with respect to a change of so that the fluctuations of the restoring force F and the distance H are canceled in a well-balanced manner. The rate of change of the restoring force F and the distance H refers to a parameter obtained by normalizing the rate of fluctuation amount of the restoring force F and the distance H with respect to a displacement of the feed roller 101 by values of the restoring force F and the distance H in the condition in which the feed roller 101 is located at the target position. In other words, their relationship may be what the distance H reduces by 0.5% to 2% when the feed roller 101 is displaced from the target position such that the restoring force F increases by 1%, i.e., an elongation of the pressurizing spring 155 increases by 1%. The rates of change of the restoring force F and the distance H when the feed roller 101 is displaced from the target position can be calculated from the values of F and H measured by supposing the displacements as 0 mm and ±1 mm by applying to a formula of numerical differentiation.

Note that in a case where the pressurizing spring 155 is disposed under the pressurizing lever 154 like the present embodiment, it is preferable to set an angle of the line of action G with respect to a horizontal plane perpendicular to a vertical direction is 30 degrees or less based on the condition in which the feed roller 101 is located at the target position. Such arrangement makes it possible to reduce an occupied range of the pressurizing spring 155 in the thickness direction of the document and to contribute to downsizing of the ADF 100.

Modified Example

Figure 14A:
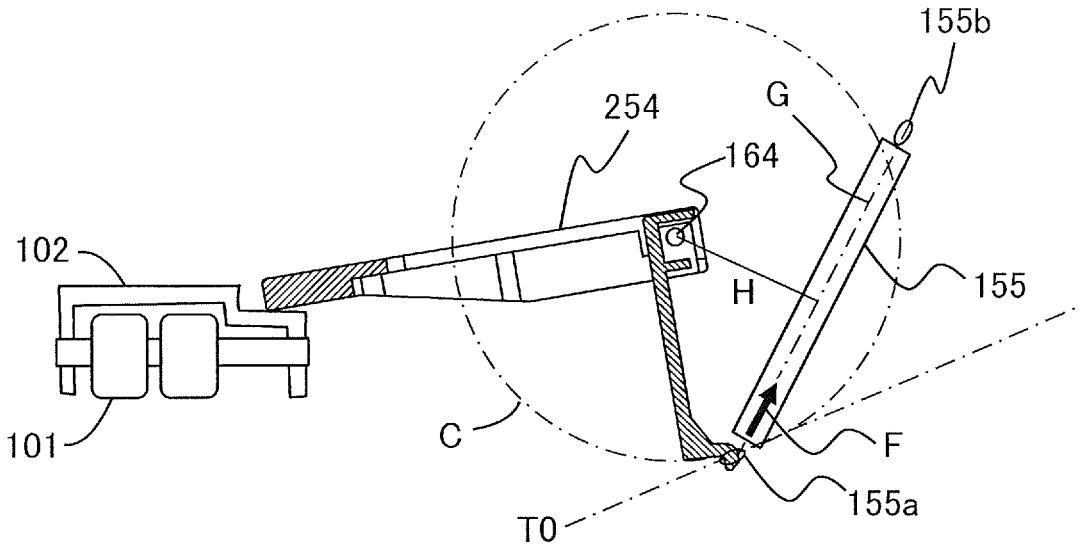
FIG. 14A is a modified example of the present embodiment.

While the pressurizing spring 155 which is a tensile coil spring is used as the elastic member and the bar-shaped pressurizing lever 154 extending from the pivot shaft 164 to the arm 102 is used in the embodiment described above, their disposition can be modified as long as substantially the same operation with the present embodiment can be obtained. For instance, as illustrated in FIG. 14A, an L-shaped pressurizing lever 254 which is ramified to a portion pressing the arm 102 and a portion connected with the pressurizing spring 155 may be used as the lever member. In this case, a position of the pressurizing spring 155 is different from that described in the abovementioned embodiment, and the restoring force F may contain a vertically upward component. Even in such arrangement, the distance H decreases/increases when the feed roller 101 is displaced upward/downward, respectively, as long as the fixed end 155*b* of the pressurizing spring 155 is disposed on the same side with the pivot shaft 164 of the pressurizing lever 254 with respect to the reference line T0. That is, an arrangement in which the distance H increases/decreases so as to cancel an increase/decrease of the restoring force F with respect to the displacement of the feed roller 101 is realized.

Figure 14B:
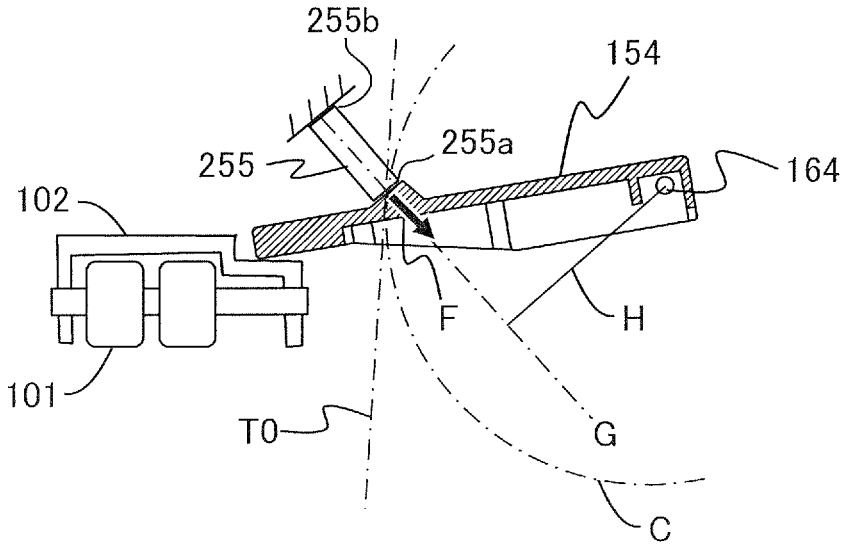
FIG. 14B is another modified example of the present embodiment.

Still further, as illustrated in FIG. 14B, a compression spring 255 may be used as the elastic member instead of the tensile spring. In FIG. 14B, a free end 255*a* of the compression spring 255 presses the pressurizing lever 154 and a fixed end 255*b* is supported by the cover body 141. In this case, if the fixed end 255*b* is disposed on a "side opposite" to the pivot shaft 164 with respect to the reference line T0, the distance H decreases/increases when the feed roller 101 is displaced upward/downward, respectively. That is, an arrangement of increasing/decreasing the distance H so as to cancel an increase/decrease of the restoring force F with respect to the displacement of the feed roller 101 is realized.

It is advantageous to use the tensile spring as the pressurizing spring 155 because a difference between a length in use and a free length can be readily assured as compared to the case of using the compression spring. That is, because the tensile spring has a small spring constant as compared to the compression spring, the tensile spring can readily stabilize the pressurizing force of the feed roller 101 by suppressing a fluctuation width of the restoring force with respect to a pivotal motion of the pressurizing lever 154.

Beside that, one other than the coil spring such as rubber and air spring may be used as the elastic member. Still further, instead of the arrangement in which the end portion of the elastic member is directly connected with the lever member, it is also possible to arrange such that a restoring force of the elastic member acts on the lever member through an intermediate member like an arrangement in which a wire hooked to the lever member is pulled by a torsion spring.

It is also possible to arrange such that a force generated by another arrangement is added to the pressurizing force of the feed roller 101 in addition to the elastic member generating the pressurizing force of the feed roller 101 by the restoring force. For instance, a weight member may be added such that weight of the weight member is added to the pressurizing force. It is also possible to arrange such that a spring clutch is disposed between the shaft 105 of the sheet feed unit 143 (see FIG. 6) and the arm 102 and such that a certain force is transmitted to the arm 102 through the spring clutch along with rotation of the feed motor 182 to add to the pressurizing force of the feed roller 101.

It is also possible to modify the disposition of the pressurizing lever 154, and a pressurizing lever extending in a direction along the sheet feeding direction from pivot shaft in parallel to the axial direction of the feed roller 101 may be used for example. The pressurizing lever 154 and the pressurizing spring 155 may be moved to a left side in FIG. 10 with respect to the feed roller 101. It is also possible to dispose two sets of the pressurizing lever 154 and the pressurizing spring 155 so as to be symmetrical with respect to the axial direction of the feed roller 101.

OTHER EMBODIMENTS

While the case in which the present technology is applied to the ADF 100 serving as the sheet feeding apparatus for feeding the document in the image reading apparatus has been described in the abovementioned embodiment, the present technology is also applicable to another sheet feeding apparatus. For instance, the present technology is also applicable to the sheet feeding apparatuses (e.g., cassettes 20 and 21) for feeding the sheet P serving as the recording medium in the image forming unit 301 (see FIG. 1).

Embodiment(s) of the present invention can also be realized by a computer of a system or apparatus that reads out and executes computer executable instructions (e.g., one or more programs) recorded on a storage medium (which may also be referred to more fully as a 'non-transitory computer-readable storage medium') to perform the functions of one or more of the above-described embodiment(s) and/or that includes one or more circuits (e.g., application specific integrated circuit (ASIC)) for performing the functions of one or more of the above-described embodiment(s), and by a method performed by the computer of the system or apparatus by, for example, reading out and executing the computer executable instructions from the storage medium to perform the functions of one or more of the above-described embodiment(s) and/or controlling the one or more circuits to perform the functions of one or more of the above-described embodiment(s). The computer may comprise one or more processors (e.g., central processing unit (CPU), micro processing unit (MPU)) and may include a network of separate computers or separate processors to read out and execute the computer executable instructions. The computer executable instructions may be provided to the computer, for example, from a network or the storage medium. The storage medium may include, for example, one or more of a hard disk, a random-access memory (RAM), a read only memory (ROM), a storage of distributed computing systems, an optical disk (such as a compact disc (CD), digital versatile disc (DVD), or Blu-ray Disc (BD)™), a flash memory device, a memory card, and the like.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2018-233664, filed on Dec. 13, 2018, which is hereby incorporated by reference herein in its entirety.

What is claimed is:

1. A sheet feeding apparatus comprising:

a sheet stacking portion on which a sheet is stacked;

a feed member disposed above the sheet stacking portion and configured to feed the sheet stacked on the sheet stacking portion;

a holding member configured to hold the feed member and being movable up and down in a vertical direction;

a lever member configured to pivot on a pivot shaft and comprising a contact portion configured to be in contact with the holding member; and an elastic member connected to the lever member and configured to urge the holding member downward through the lever member, wherein the elastic member is disposed such that, when viewed in an axial direction of the pivot shaft of the lever member, a distance from the pivot shaft to a line of action of a force applied by the elastic member to the lever member when the feed member is located at a first position is shorter than a distance from the pivot shaft to the line of action when the feed member is located at a second position below the first position, wherein when view in the vertical direction, the lever member extends in a width direction perpendicular to a sheet feeding direction of the feed member from the contact portion contacting the holding member to the pivot shaft, and wherein a position in the sheet feeding direction where the contact portion of the lever member comes into contact with the holding member overlaps with a position of the feed member in the sheet feeding direction.

2. The sheet feeding apparatus according to claim 1, further comprising:

a lift portion configured to lift the sheet stacking portion;

a detection unit configured to detect height of an upper surface of the sheet stacked in the sheet stacking portion; and a control portion configured to operate the lift portion to lift the sheet stacking portion such that the upper surface of the sheet stacked on the sheet stacking portion comes into contact with the feed member based on a detection result of the detection unit.

3. A sheet feeding apparatus comprising:

a sheet stacking portion on which a sheet is stacked;

a feed member disposed above the sheet stacking portion and configured to feed the sheet stacked on the sheet stacking portion;

a lift portion configured to lift the sheet stacking portion;

a driving source configured to drive the lift portion;

a detection unit configured to detect height of an upper surface of the sheet stacked on the sheet stacking portion;

a control portion configured to control the driving source so as to lift the sheet stacking portion by the lift portion based on a detection result of the detection unit;

a holding member configured to hold the feed member and movable up and down;

a lever member configured to pivot on a pivot shaft and comprising a contact portion configured to be in contact with the holding member; and an elastic member connected to the lever member and configured to urge the holding member downward through the lever member, wherein the elastic member is disposed such that, when viewed in an axial direction of the pivot shaft of the lever member, a distance from the pivot shaft to a line of action of a force applied by the elastic member to the lever member in a case where the feed member is located at a first position is shorter than a distance from the pivot shaft to the line of action in a case where the feed member is located at a second position below the first position.

4. The sheet feeding apparatus according to claim 3, wherein the detection unit is configured to detect that the upper surface of the sheet stacked on the sheet stacking portion is on or above a detection position, and wherein in a case where the detection unit detects that an upper surface of a plurality of sheets stacked on the sheet stacking portion is lower than the detection position while the control portion executing a feed operation of feeding the plurality of sheets one by one by the feed member, the control portion operates the lift portion to lift the sheet stacking portion, until the upper surface of the plurality of sheets moves to an upper position by a predetermined distance from the detection position, and continues the feed operation.

5. The sheet feeding apparatus according to claim 4, wherein the distance from the pivot shaft to the line of action becomes longer as the feed member is lowered for an entire range in which the feed member moves in a case where the upper surface of the plurality of sheets moves up and down between the detection position and a position above the detection position by the predetermined distance.

6. The sheet feeding apparatus according to claim 4, wherein the detection unit is a photo-interrupter of which the detection result changes in response to a position of the holding member, and wherein the holding member comprises a flag portion configured to shade the photo-interrupter in a case where the feed member is located at the detection position and not to shade the photo-interrupter in a case where the feed member is lower than the detection position.

7. The sheet feeding apparatus according to claim 3, wherein the elastic member is disposed such that the distance from the pivot shaft to the line of action in a case where the feed member is located at the first position is longer than a distance from the pivot shaft to the line of action in a case where the feed member is located at a third position above the first position.

8. The sheet feeding apparatus according to claim 3, wherein the elastic member is a tensile spring of which one end is attached to an attachment portion of the lever member and another end is fixed, the tensile spring being configured to become shorter when the feed member is lowered from the first position to the second position and to become longer when the feed member rises from the second position to the first position.

9. The sheet feeding apparatus according to claim 8, wherein when viewed in the axial direction of the pivot shaft of the lever member, the other end of the elastic member is located on the same side with the pivot shaft with respect to a tangential line of a circle drawn by the attachment portion when the lever member pivots, the tangential line passing through a position of the attachment portion in a case where the feed member is located at the first position.

10. The sheet feeding apparatus according to claim 8, wherein the other end of the elastic member is located below the pivot shaft of the lever member, and an angle of the line of action with respect to a horizontal plane is 30 degrees or less in a case where the feed member is located at the first position.

11. The sheet feeding apparatus according to claim 3, wherein in a case where the feed member is displaced from the first position, a ratio of (i) a rate of change of the distance from the pivot shaft to the line of action to (ii) a rate of change of the force applied to the lever member from the elastic member is not less than −2.0 and not greater than −0.5.

12. The sheet feeding apparatus according to claim 3, wherein a product of a magnitude of the force applied to the lever member from the elastic member and the distance from the pivot shaft to the line of action reaches an extremum in a case where the feed member is located at a position between both ends of a movable range of the feed member.

13. The sheet feeding apparatus according to claim 3, wherein when viewed in a vertical direction, the lever member extends in a width direction perpendicular to a sheet feeding direction of the feed member from the contact portion contacting the holding member to the pivot shaft, and wherein a position in the sheet feeding direction where the contact portion of the lever member is in contact with the holding member overlaps with a position of the feed member in the sheet feeding direction.

14. The sheet feeding apparatus according to claim 13, further comprising:

a conveyance roller disposed downstream of the feed member in the sheet feeding direction and configured to convey the sheet; and a driving shaft provided on a rotation axis of the conveyance roller and configured to transmit a driving force to the conveyance roller and the feed member, wherein the lever member and the driving shaft are disposed on a same side, in the width direction, with respect to a sheet feeding unit including the conveyance roller, the feed member and the holding member.

15. The sheet feeding apparatus according to claim 14, further comprising:

a frame supporting the sheet stacking portion; and a cover member pivotally supported by the frame and configured to pivot such that a conveyance path for the sheet fed by the feed member is opened and closed, wherein the lever member and the elastic member are attached to the cover member, and wherein the sheet feeding unit is configured to be attached to and detached from the cover member in a condition in which the lever member and the elastic member are attached to the cover member.

16. The sheet feeding apparatus according to claim 15, wherein the cover member comprises a cover portion covering at least a part of the lever member and the elastic member.

17. An image reading apparatus comprising:

a sheet feeding apparatus configured to feed a sheet; and an image reading portion configured to read image information from the sheet fed from the sheet feeding apparatus, wherein the sheet feeding apparatus comprises:

a sheet stacking portion on which a sheet is stacked;

a feed member disposed above the sheet stacking portion and configured to feed the sheet stacked on the sheet stacking portion;

a lift portion configured to lift the sheet stacking portion;

a driving source configured to drive the lift portion;

a detection unit configured to detect height of an upper surface of the sheet stacked on the sheet stacking portion;

a control portion configured to control the driving source so as to lift the sheet stacking portion by the lift portion based on a detection result of the detection unit;

a holding member configured to hold the feed member and movable up and down;

a lever member configured to pivot on a pivot shaft and comprising a contact portion configured to be in contact with the holding member; and an elastic member connected to the lever member and configured to urge the holding member downward through the lever member, wherein the elastic member is disposed such that, when viewed in an axial direction of the pivot shaft of the lever member, a distance from the pivot shaft to a line of action of a force applied by the elastic member to the lever member in a case where the feed member is located at a first position is shorter than a distance from the pivot shaft to the line of action in a case where the feed member is located at a second position below the first position.

18. An image forming apparatus comprising:

a sheet feeding apparatus configured to feed a sheet;

an image forming unit configured to form an image on the sheet fed from the sheet feeding apparatus, wherein the sheet feeding apparatus comprises:

a sheet stacking portion on which a sheet is stacked;

a feed member disposed above the sheet stacking portion and configured to feed the sheet stacked on the sheet stacking portion;

a lift portion configured to lift the sheet stacking portion;

a driving source configured to drive the lift portion;

a detection unit configured to detect height of an upper surface of the sheet stacked on the sheet stacking portion;

a control portion configured to control the driving source so as to lift the sheet stacking portion by the lift portion based on a detection result of the detection unit;

a holding member configured to hold the feed member and movable up and down;

a lever member configured to pivot on a pivot shaft and comprising a contact portion configured to be in contact with the holding member; and an elastic member connected to the lever member and configured to urge the holding member downward through the lever member, wherein the elastic member is disposed such that, when viewed in an axial direction of the pivot shaft of the lever member, a distance from the pivot shaft to a line of action of a force applied by the elastic member to the lever member in a case where the feed member is located at a first position is shorter than a distance from the pivot shaft to the line of action in a case where the feed member is located at a second position below the first position.

* * * * *